US011873125B2

(12) United States Patent
Ueta

(10) Patent No.: US 11,873,125 B2
(45) Date of Patent: Jan. 16, 2024

(54) DRUG SUPPLYING DEVICE AND DRUG PACKAGING DEVICE

(71) Applicant: PHC HOLDINGS CORPORATION, Tokyo (JP)

(72) Inventor: Toshiaki Ueta, Tokushima (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 547 days.

(21) Appl. No.: 17/125,423

(22) Filed: Dec. 17, 2020

(65) Prior Publication Data

US 2021/0101703 A1 Apr. 8, 2021

Related U.S. Application Data

(63) Continuation of application No. PCT/JP2019/024062, filed on Jun. 18, 2019.

(30) Foreign Application Priority Data

Jun. 21, 2018 (JP) ..... 2018-117671

(51) Int. Cl.
*B65B 57/14* (2006.01)
*B65B 1/30* (2006.01)
*B65B 37/02* (2006.01)

(52) U.S. Cl.
CPC ..... *B65B 1/30* (2013.01); *B65B 37/02* (2013.01); *B65B 57/14* (2013.01)

(58) Field of Classification Search
CPC ..... G07F 17/0092; B65B 57/14; B65B 37/02; B65B 5/103
See application file for complete search history.

(56) References Cited

U.S. PATENT DOCUMENTS 5,678,393 A 10/1997 Yuyama et al.
5,758,477 A * 6/1998 Wilson, Jr. ..... B65B 57/20 53/493

(Continued)

FOREIGN PATENT DOCUMENTS

CN 103318591 A 9/2013
CN 203294640 U 11/2013

(Continued)

OTHER PUBLICATIONS

Office Action dated Jan. 24, 2022 issued in the corresponding European Patent Application No. 19822151.7.

(Continued)

*Primary Examiner* — Jason K Niesz
(74) *Attorney, Agent, or Firm* — Rimon P.C.

(57) ABSTRACT

A drug supplying device provided with: a first drug discharging section that discharges a first drug from a first tablet case; a first temporary storage section that is arranged downstream of the first drug discharging section in a path, and that temporarily stores the first drug; a second drug discharging section that is arranged downstream of the first temporary storage section in the path, and that discharges a second drug from a second tablet case; a second temporary storage section that is arranged downstream of the second drug discharging section in the path, and that temporarily stores the first drug and the second drug; and a third drug discharging section that is arranged downstream of the second temporary storage section in the path, and that discharges a third drug from a third tablet case.

5 Claims, 6 Drawing Sheets

(56) References Cited

U.S. PATENT DOCUMENTS

| | | | | |
|---|---|---|---|---|
| 2004/0154688 | A1* | 8/2004 | Geltser | B65B 57/20 141/2 |
| 2008/0011764 | A1* | 1/2008 | Geltser | A61J 7/02 221/1 |
| 2014/0103063 | A1* | 4/2014 | Yuyama | G07F 17/0092 221/306 |

FOREIGN PATENT DOCUMENTS

| | | | |
|---|---|---|---|
| JP | 57-002241 | Y | 1/1982 |
| JP | H08-192801 | A | 7/1996 |
| JP | H09-323704 | A | 12/1997 |

OTHER PUBLICATIONS

Extended European Search Report dated Jul. 1, 2021, issued in the corresponding European Patent Application No. 19822151.7.

International Search Report and Written Opinion issued in International Patent Application No. PCT/JP2019/024062, dated Sep. 24, 2019; with partial English translation.

* cited by examiner

DRUG SUPPLYING DEVICE AND DRUG PACKAGING DEVICE

CROSS-REFERENCE OF RELATED APPLICATIONS

This application is a Continuation of International Patent Application No. PCT/JP2019/024062, filed on Jun. 18, 2019, which in turn claims the benefit of Japanese Application No. 2018-117671, filed on Jun. 21, 2018, the entire disclosures of which applications are incorporated by reference herein.

TECHNICAL FIELD

The present invention relates to a medicine supplying apparatus and a medicine packaging apparatus.

BACKGROUND ART

Conventionally, a tablet packaging machine is known in which a tablet designated in a prescription is discharged from a tablet case storing various tablets, and the discharged tablet is automatically packaged. Such a tablet packaging machine packages tablets that the patient should take at one time according to the information written on the prescription. The tablet packaging machine also prints on the surface of a pouch information such as the date and time the patient should take the tablet.

This allows the patient to select the pouch in which all tablets to be taken are enclosed based on the information printed on the surface of the pouch without having to individually select tablets to be taken from among the prescribed tablets.

PTL 1 describes a medicine supplying apparatus discharging a medicine designated by a prescription from a plurality of medicine storage containers arranged in vertical directions and left-right directions, and collecting the discharged medicine by a hopper disposed at a lower portion of these medicine storage containers to supply the pouch.

CITATION LIST

Patent Literature

PTL1
Japanese Examined Utility Model (Registration) Application Publication No. S57-2241

SUMMARY OF INVENTION

Technical Problem

In the above-described medicine supplying apparatus, it takes at least the time that the medicine discharged from the medicine storage container arranged at the top step reaches the pouch, until the medicine discharged from each the medicine discharged from the medicine storage container is stored in the pouch. For this reason, it takes longer for the medicine to reach the pouch in the case of the prescription using the medicine storage container on the upper side of the medicine storage containers arranged in the vertical direction, the time for storing the medicine in the pouch is increased.

In such a medicine supplying apparatus, it is desired to shorten the time for supplying the medicine to the pouch.

It is an object of the present invention to shorten a time period for supplying a medicine to a pouch in a medicine supplying apparatus in which a plurality of medicine storage containers are arranged in a vertical direction.

Solution to Problem

In order to achieve the above object, a medicine supplying apparatus comprising: a first medicine discharging portion configured to discharge a first medicine from a first tablet case storing the first medicine; a first temporary storage disposed on a downstream side of the first medicine discharging portion in a path through which the first medicine drops, and temporarily storing the first medicine; a second medicine discharging portion disposed on the downstream side of the first temporary storage in the path, and configured to discharge a second medicine from a second tablet case storing the second medicine; a second temporary storage disposed on a downstream side of the second medicine discharging portion in the path and temporarily storing the first medicine and the second medicine; and a third medicine discharging portion disposed on the downstream side of the second temporary storage in the path, and configured to discharge a third medicine from a third tablet case storing the third medicine.

Advantageous Effects of Invention

According to the present invention, it is possible to shorten the time for supplying the medicine to the pouch.

DESCRIPTION OF EMBODIMENTS

Hereinafter, embodiments of the present invention will be described in detail with reference to the drawings. In the following description, the directions indicated by the arrows in FIGS. 1 and 2 are conveniently assumed to be up, down, left, and right.

Embodiment 1

Figure 1:
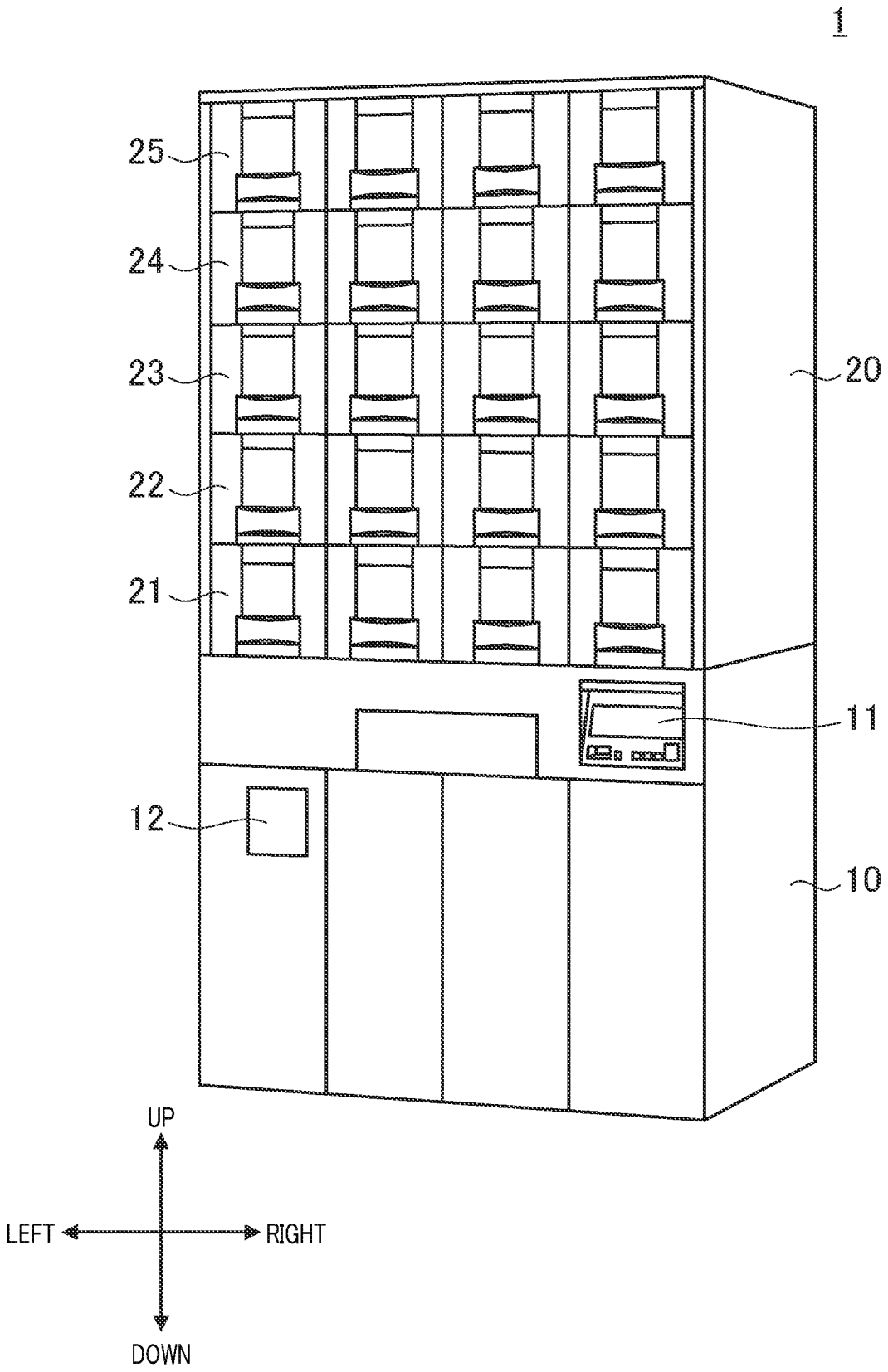
FIG. 1 is a perspective view illustrating an example of a medicine packaging apparatus according to Embodiment 1.
Figure 2:
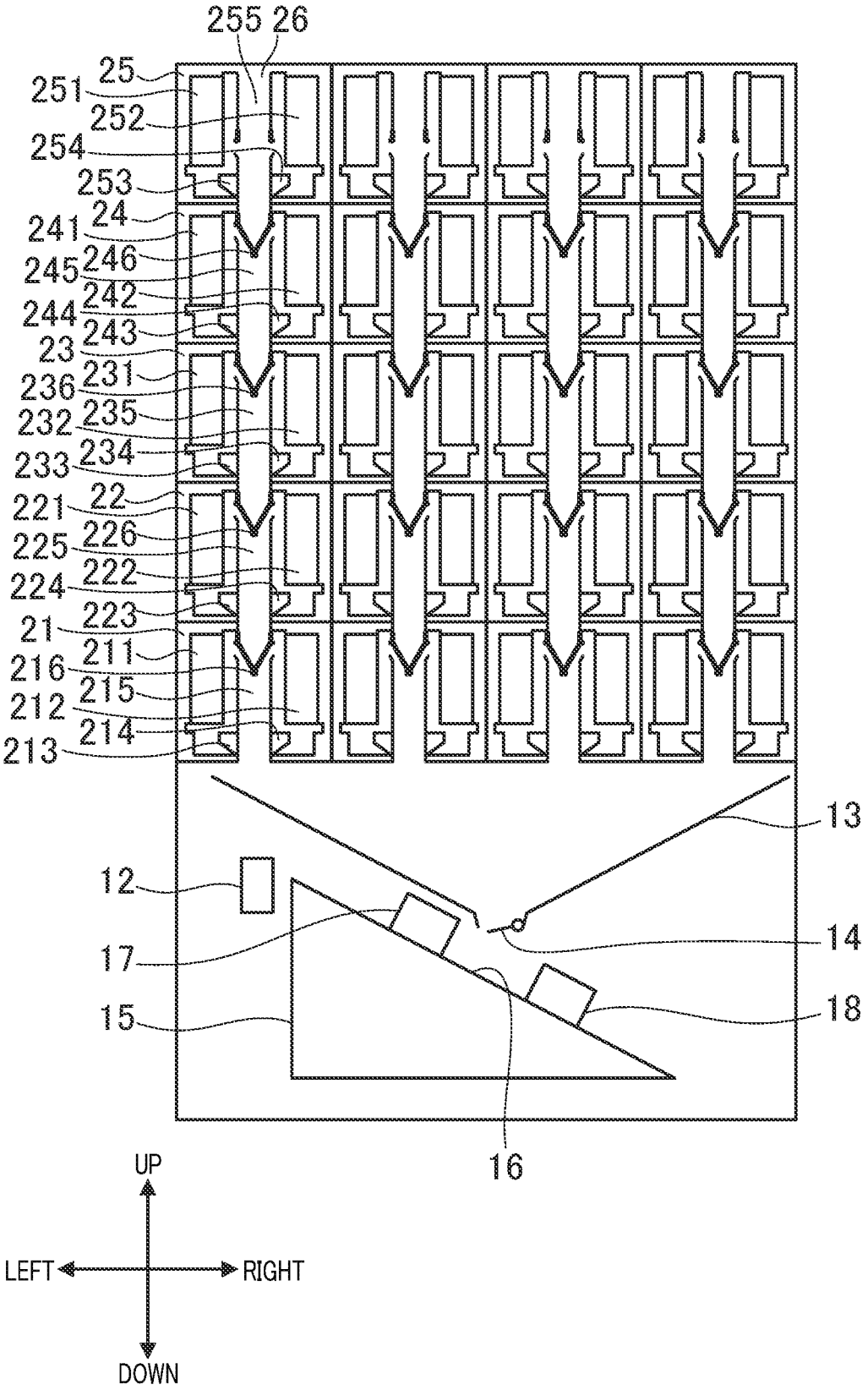
FIG. 2 is a longitudinal cross-sectional view of the medicine packaging apparatus according to Embodiment 1.

FIG. 1 is a perspective view illustrating an example of medicine packaging apparatus 1.

Medicine packaging apparatus 1 has first floor 10 and second floor 20.

First floor 10 has operating portion 11 and take-out portion 12. Further, first floor 10 has an input portion (not illustrated) and a controller (not illustrated) and/or the like.

Operating portion 11 is a device operated by an operator. Operating portion 11 has, for example, a display, operation buttons, and/or the like. Various information is input to medicine packaging apparatus 1 by operating portion 11 by the user.

The medicine packaged in medicine packaging apparatus 1 is taken out from take-out portion 12. Take-out portion 12 has an opening, and the user takes out the medicine through the opening.

The input portion is an input device to which various information is input from an external device. The input portion is connected to, for example, a personal computer. The information about a prescription issued at, for example, a medical institution is input to the input portion from the personal computer.

The controller is a control device for controlling each portion of medicine packaging apparatus 1. The controller controls operating portion 11, a discharging portion described later, storages and/or the like. Further, the controller controls each portion so that the medicine designated by the prescription is packaged into a pouch based on the information of the prescription input from the input portion, and is conveyed to take-out portion 12.

Second floor 20 has a plurality of first drawers 21 arranged in the left-right direction. Second floor 20 has a plurality of second drawers 22 arranged in the left-right direction on the upside of first drawers 21. Second floor 20 has a plurality of third drawers 23 arranged in the left-right direction on the upside of the second drawers 22. Second floor 20 has a plurality of fourth drawers 24 arranged in the left-right direction on the upside of the third drawers 23. Second floor 20 has a plurality of fifth drawers 25 arranged in the left-right direction on the upside of the fourth drawers 24. That is, second floor 20 has a plurality of drawers in the vertical and horizontal directions. The number of drawers provided in second floor 20 is not limited to this, and a larger number of drawers may be provided in the vertical and/or horizontal directions, or a smaller number of drawers may be provided.

Next, the internal structure of second floor 20 and first floor 10 will be described with reference to FIG. 2. FIG. 2 is a longitudinal cross-sectional view of medicine packaging apparatus 1.

First drawer 21 has first left side tablet case 211 and first right side tablet case 212 arranged side by side in the left-right direction. First left side tablet case 211 and first right side tablet case 212 are each configured by a plurality of tablet cases arranged in the depth direction of first drawer 21. First left side tablet case 211 and first right side tablet case 212 store the medicine such as a tablet inside. Further, first drawer 21 has first left side discharging portion 213 for discharging the medicine stored inside first left side tablet case 211 near the lower end of first left side tablet case 211. Similarly, first drawer 21 has first right side discharging portion 214 for discharging the medicine stored inside first right side tablet case 212 near the lower end of first right side tablet case 212. First left side discharging portion 213 and first right side discharging portion 214 configures a first discharging portion.

First left side tablet case 211 and first right side tablet case 212 each have a discharge mechanism for discharging the medicine. First left side discharging portion 213 and first right side discharging portion 214 each have a driving portion for driving the discharge mechanism of first left side tablet case 211 and first right side tablet case 212. When the driving portion is driven, first left side discharging portion 213 and first right side discharging portion 214 discharge the medicine stored inside first left side tablet case 211 and first right side tablet case 212, respectively, toward path 26.

Between first left side tablet case 211 and first right side tablet case 212, first path 215 through which the medicine discharged from each tablet case drops is formed. First path 215 communicates with first floor 10 to cause the medicine discharged from the first discharging portion to drop toward first floor 10.

First storage 216 for temporarily storing the medicine is provided near the upper end of first path 215. First storage 216 is configured by, for example, a shutter that opens and closes first path 215. That is, first storage 216 temporarily stores the medicine which drops in first path 215 by closing first path 215, and causes the stored medicine to flow down to the downstream side by opening first path 215

Second drawer 22 has second left side tablet case 221 and second right side tablet case 222 arranged side by side in the left-right direction. Second drawer 22 has second left side discharging portion 223 for discharging the medicine stored inside second left side tablet case 221 near the lower end of second left side tablet case 221. Similarly, second drawer 22 has second right side discharging portion 224 for discharging the medicine stored inside second right side tablet case 222 near the lower end of second right side tablet case 222. Second left side discharging portion 223 and second right side discharging portion 224 configures a second discharging portion. Note that second left side tablet case 221 and second right side tablet case 222 are similar to first left side tablet case 211 and first right side tablet case 212 provided in first drawer 21

Between second left side tablet case 221 and second right side tablet case 222, second path 225 through which the medicine discharged from each tablet case drops is formed. Second path 225 communicates with first path 215 formed in first drawer 21 to cause the medicine discharged from the second discharging portion to drop toward first path 215.

Second storage 226 for temporarily storing the medicine is provided near the upper end of second path 225. Second storage 226 is configured by, for example, a shutter that opens and closes second path 225. That is, second storage 226 temporarily stores the medicine which drops in second path 225 by closing second path 225, and causes the stored medicine to flow down to the downstream side by opening second path 225.

Third drawer 23 has third left side tablet case 231 and third right side tablet case 232 arranged side by side in the left-right direction. Third drawer 23 has third left side discharging portion 233 for discharging the medicine stored inside third left side tablet case 231 near the lower end of third left side tablet case 231. Similarly, third drawer 23 has third right side discharging portion 234 for discharging the medicine stored inside third right side tablet case 232 near the lower end of third right side tablet case 232. Third left side discharging portion 233 and third right side discharging portion 234 configures a third discharging portion. Note that third left side tablet case 231 and third right side tablet case 232 are similar to first left side tablet case 211 and first right side tablet case 212 provided in first drawer 21

Between third left side tablet case 231 and third right side tablet case 232, third path 235 through which the medicine discharged from each tablet case drops is formed. Third path 235 communicates with second path 225 formed in second drawer 22 to cause the medicine discharged from the third discharging portion to drop toward second path 225.

Third storage 236 for temporarily storing the medicine is provided near the upper end of third path 235. Third storage 236 is configured by, for example, a shutter that opens and closes third path 235. That is, third storage 236 temporarily stores the medicine which drops in third path 235 by closing third path 235, and causes the stored medicine to flow down to the downstream side by opening third path 235.

Fourth drawer 24 has fourth left side tablet case 241 and fourth right side tablet case 242 arranged side by side in the left-right direction. Fourth drawer 24 has fourth left side discharging portion 243 for discharging the medicine stored inside fourth left side tablet case 241 near the lower end of fourth left side tablet case 241. Similarly, fourth drawer 24 has fourth right side discharging portion 244 for discharging the medicine stored inside fourth right side tablet case 242 near the lower end of fourth right side tablet case 242. Fourth left side discharging portion 243 and fourth right side discharging portion 244 configures a fourth discharging portion. Note that fourth left side tablet case 241 and fourth right side tablet case 242 are similar to first left side tablet case 211 and first right side tablet case 212 provided in first drawer 21

Between fourth left side tablet case 241 and fourth right side tablet case 242, fourth path 245 through which the medicine discharged from each tablet case drops is formed. Fourth path 245 communicates with third path 235 formed in third drawer 23 to cause the medicine discharged from the fourth discharging portion to drop toward third path 235.

Fourth storage 246 for temporarily storing the medicine is provided near the upper end of fourth path 245. Fourth storage 246 is configured by, for example, a shutter that opens and closes fourth path 245. That is, fourth storage 246 temporarily stores the medicine which drops in fourth path 245 by closing fourth path 245, and causes the stored medicine to flow down to the downstream side by opening fourth path 245.

Fifth drawer 25 has fifth left side tablet case 251 and fifth right side tablet case 252 arranged side by side in the left-right direction. Fifth drawer 25 has fifth left side discharging portion 253 for discharging the medicine stored inside fifth left side tablet case 251 near the lower end of fifth left side tablet case 251. Similarly, fifth drawer 25 has fifth right side discharging portion 254 for discharging the medicine stored inside fifth right side tablet case 252 near the lower end of fifth right side tablet case 252. Fifth left side discharging portion 253 and fifth right side discharging portion 254 configures a fifth discharging portion. Note that fifth left side tablet case 251 and fifth right side tablet case 252 are similar to first left side tablet case 211 and first right side tablet case 212 provided in first drawer 21

Between fifth left side tablet case 251 and fifth right side tablet case 252, fifth path 255 through which the medicine discharged from each tablet case drops is formed. Fifth path 255 communicates with fourth path 245 formed in fourth drawer 24 to cause the medicine discharged from the fourth discharging portion to drop toward fourth path 245.

As described above, first path 215 communicates with first floor 10, second path 225 communicates with first path 215, third path 235 communicates with second path 225, fourth path 245 communicates with third path 235, and fifth path 255 communicates with fourth path 245. That is, first path 215, second path 225, third path 235, fourth path 245, and fifth path 255 form one path 26 communicating with first floor 10.

As described above, first storage 216, second storage 226, third storage 236, and fourth storage 246 are provided near the upper ends of first path 215, second path 225, third path 235, and fourth path 245, respectively.

That is, first storage 216 is provided near the second discharging portion between the first discharging portion and the second discharging portion.

Second storage 226 is provided near the third discharging portion between the second discharging portion and the third discharging portion.

Third storage 236 is provided near the fourth discharging portion between the third discharging portion and the fourth discharging portion.

Fourth storage 246 is provided near the fifth discharging portion between the fourth discharging portion and the fifth discharging portion.

Next, first floor 10 will be described. First floor 10 has hopper 13 and packaging unit 15.

Hopper 13 is a member for receiving the medicine dropping in path 26. Hopper 13 is inclined downward from the left and right toward the center. The lowermost portion of hopper 13 is provided with opening and closing member 14, the medicine received by hopper 13 is collected in opening and closing member 14.

Packaging unit 15 has transferring portion 16, printer 17, and sealing device 18.

Transferring portion 16 is, for example, a device for feeding out wrapping paper from a roller (not illustrated) on which a folded belt-shaped wrapping paper is wound to transfer the fed-out wrapping paper toward sealing device 18 side.

Printer 17 is a printing machine for printing, for example, a name of a patient, a name of a medicine supplied to the packaging paper, and the taking time and date, and/or the like, on the surface of the packaging paper fed out from the roller.

Sealing device 18 is a device for sealing the wrapping paper after the medicine is supplied from opening and closing member 14 to the wrapping paper.

The packaging paper in which the medicine is enclosed is, for example, cut at a predetermined timing, and transferred toward take-out portion 12 by a predetermined device.

Next, the operation of second floor 20 will be described. In second floor 20, based on an instruction from the control portion, each discharging portion discharges the medicine stored in each tablet case to supply the medicine to packaging unit 15 of first floor 10. That is, second floor 20 functions as a medicine supplying device for supplying a medicine to packaging unit 15.

Figure 3:
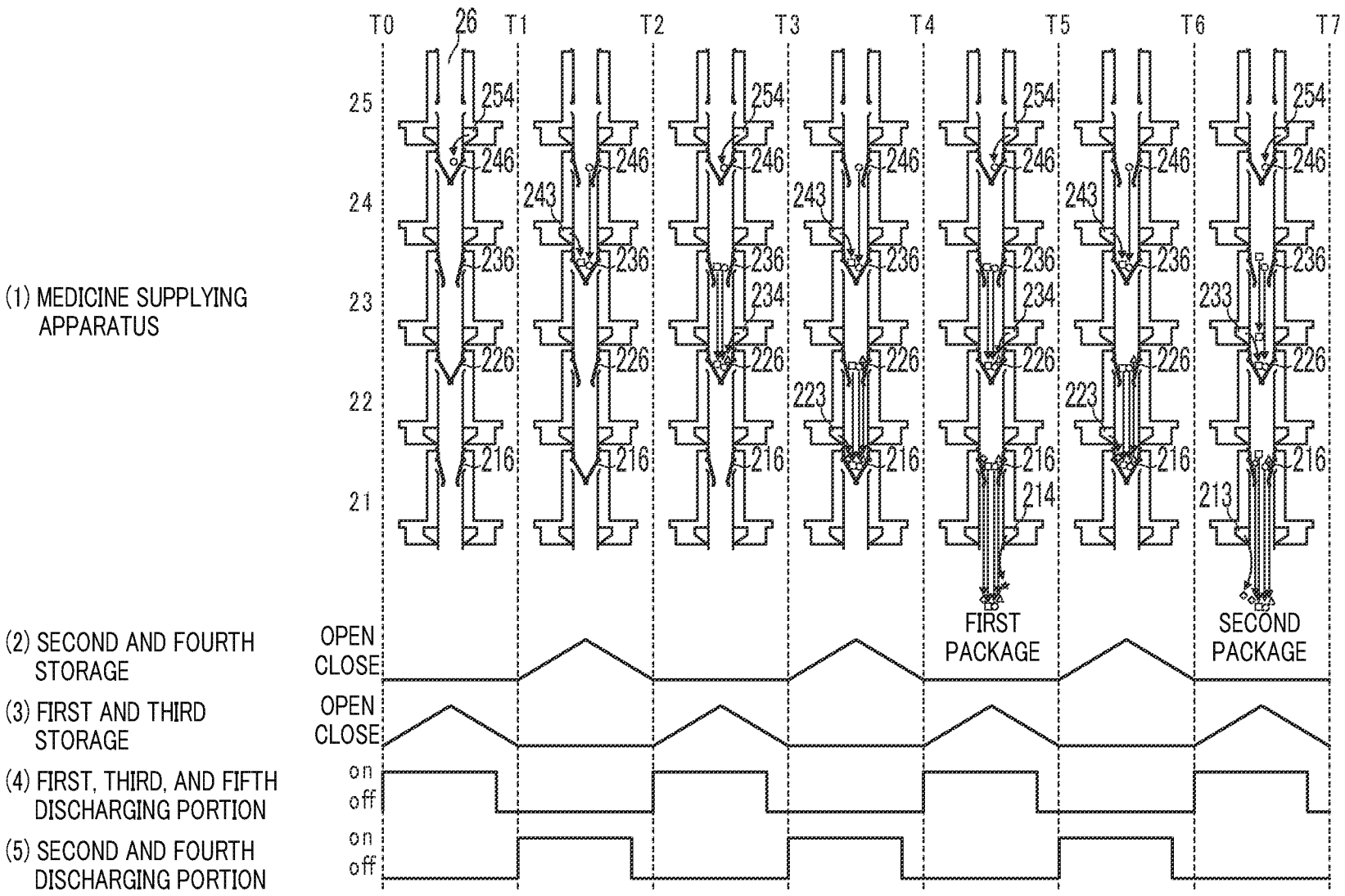
FIG. 3 is a diagram for explaining an example of an operation of a second floor according to Embodiment 1.

FIG. 3 is a diagram for explaining an example of the operation of second floor 20. Here, it will be described about an example in which the medicine is discharged from fifth right side discharging portion 254, fourth left side discharging portion 243, third left side discharging portion 233, third right side discharging portion 234, second left side discharging portion 223, first left side discharging portion 213, and first right side discharging portion 214.

The diagram (1) of FIG. 3 illustrates a state in which the medicine discharged from each discharging portion drops, and a state in which the dropped medicine is stored in each storage, in time series from the left side to the right side. The diagram (2) of FIG. 3 illustrates an opened and closed state of second storage 226 and fourth storage 246. The diagram (3) of FIG. 3 illustrates an opened and closed state of first storage 216 and third storage 236. The diagram (4) of FIG. 3 illustrates a driving state of the first discharging portion, the third discharging portion, and the fifth discharging portion. The diagram (5) of FIG. 3 illustrates a driving state of the second discharging portion and the fourth discharging portion.

First, at time T0, the controller starts outputting a driving signal to the driving portion provided in fifth right side discharging portion 254. The controller outputs the driving signal for a predetermined period, to drive the driving portion. Herewith, fifth right side discharging portion 254 discharges the medicine stored inside fifth right side tablet case 252 toward path 26. At this time, the medicine discharged from fifth right side tablet case 252 is a medicine to be packaged in the first package in packaging unit 15.

After the controller starts outputting the driving signal, until the medicine discharged from fifth right side discharging portion 254 reaches the position of fourth storage 246, fourth storage 246 and second storage 226 is maintained in the closed state of closing path 26 (see the diagram (2) of FIG. 3). Herewith, the medicine discharged from fifth right side discharging portion 254 is stored in fourth storage 246.

On the other hand, at time T0, the controller shifts third storage 236 and first storage 216 from the closed state of closing path 26 to the opened state of opening path 26.

Thereafter, the controller shift third storage 236 and first storage 216 from the opened state of opening path 26 to the closed state of closing path 26. At time T1, third storage 236 and first storage 216 close path 26.

At time T1, the controller starts outputting the driving signal to the driving portion provided in fourth left side discharging portion 243. The controller outputs the driving signal for a predetermined period, to drive the driving portion. Herewith, fourth left side discharging portion 243 discharges the medicine stored inside fourth left side tablet case 241 toward path 26. At this time, the medicine discharged from fourth left side tablet case 241 is a medicine to be packaged in the first package in packaging unit 15.

After the controller starts outputting the driving signal, until the medicine discharged from fourth left side discharging portion 243 reaches third storage 236, third storage 236 and first storage 216 is maintained in the closed state of closing path 26 (see the diagram (3) of FIG. 3). Herewith, the medicine discharged from fourth left side discharging portion 243 is stored in third storage 236.

On the other hand, at time T1, the controller shifts fourth storage 246 and second storage 226 from the closed state of closing path 26 to the opened state of opening path 26. Herewith, the medicine stored in fourth storage 246 is received by third storage 236, and is stored in third storage 236 together with the medicine discharged from fourth left side discharging portion 243.

The controller shifts fourth storage 246 and second storage 226 to the opened state, and then shifts them to the closed state again. At time T2, fourth storage 246 and second storage 226 close path 26.

At time T2, the controller starts outputting the driving signal to the driving portion provided in fifth right side discharging portion 254 and third right side discharging portion 234. The controller outputs the driving signal for a predetermined period, to drive the driving portion. Herewith, fifth right side discharging portion 254 and third right side discharging portion 234 discharge the medicine stored inside fifth right side tablet case 252 and third right side tablet case 232 toward path 26. At this time, the medicine discharged from fifth right side tablet case 252 is a medicine to be packaged in the second package in packaging unit 15. The medicine discharged from third right side tablet case 232 is a medicine to be packaged in the first package in packaging unit 15.

After the controller starts outputting the driving signal, until the medicine discharged from fifth right side discharging portion 254 and the medicine discharged from third right side discharging portion 234 reach the position where fourth storage 246 is disposed and the position where second storage 226 is disposed respectively, fourth storage 246 and second storage 226 are maintained in the closed state of closing path 26 (see the diagram (2) of FIG. 3). Herewith, the medicine discharged from fifth right side discharging portion 254 is stored in fourth storage 246. The medicine discharged from third right side discharging portion 234 is stored in second storage 226.

On the other hand, at time T2, the controller shifts third storage 236 and first storage 216 from the closed state of closing path 26 to the opened state of opening path 26. Herewith, the medicine stored in third storage 236 is received by second storage 226, and is stored in second storage 226 together with the medicine discharged from third right side discharging portion 234.

The controller shifts third storage 236 and first storage 216 to the opened state, and then shifts them to the closed state again. At time T3, third storage 236 and first storage 216 close path 26.

At time T3, the controller starts outputting the driving signal to the driving portion provided in fourth left side discharging portion 243 and second left side discharging portion 223. The controller outputs the driving signal for a predetermined period, to drive the driving portion. Herewith, fourth left side discharging portion 243 and second left side discharging portion 223 discharge the medicine stored inside fourth left side tablet case 241 and second left side tablet case 221 toward path 26. At this time, the medicine discharged from fourth left side tablet case 241 is a medicine to be packaged in the second package in packaging unit 15. The medicine discharged from second left side tablet case 221 is a medicine to be packaged in the first package in packaging unit 15.

After the controller starts outputting the driving signal, until the medicine discharged from fourth left side discharging portion 243 and the medicine discharged from second left side discharging portion 223 reach the position where third storage 236 is disposed and the position where first storage 216 is disposed respectively, third storage 236 and first storage 216 are maintained in the closed state of closing path 26 (the diagram (3) of FIG. 3). Herewith, the medicine discharged from fourth left side discharging portion 243 is stored in third storage 236. The medicine discharged from second left side discharging portion 223 is stored in first storage 216.

On the other hand, at time T3, the controller shift fourth storage 246 and second storage 226 from the closed state of closing path 26 to the opened state of opening path 26. Herewith, the medicine stored in fourth storage 246 is received by third storage 236, and is stored in third storage 236 together with the medicine discharged from fourth left side discharging portion 243. The medicine stored in second storage 226 is received by first storage 216, and stored in first storage 216 together with the medicine discharged from second left side discharging portion 223.

The controller shifts fourth storage 246 and second storage 226 to the opened state, and then shifts them to the closed state again. At time T4, fourth storage 246 and second storage 226 close path 26.

At time T4, the controller starts outputting a driving signal to the driving portion provided in fifth right side discharging portion 254, third right side discharging portion 234, and first right side discharging portion 214. The controller outputs the driving signal for a predetermined period, to drive the driving portion. Herewith, fifth right side discharging portion 254, third right side discharging portion 234, and the first right side discharging portion 214 discharge the medicine stored inside fifth right side tablet case 252, third right side tablet case 232, and first right side tablet case 212 toward path 26, respectively. At this time, the medicine discharged from fifth right side tablet case 252 is a medicine to be packed in the third package in packaging unit 15. The medicine discharged from third right side tablet case 232 is a medicine to be packaged in the second packages in packaging unit 15. The medicine discharged from first right side tablet case 212 is a medicine to be packaged in the first package in packaging unit 15.

After the controller starts outputting the driving signal, until the medicine discharged from fifth right side discharging portion 254 and the medicine discharged from third right side discharging portion 234 reach the position where fourth storage 246 is disposed and the position where second storage 226 is disposed respectively, fourth storage 246 and second storage 226 are maintained in the closed state of closing path 26 (see the diagram (2) of FIG. 3). Herewith, the medicine discharged from fifth right side discharging portion 254 is stored in fourth storage 246. The medicine discharged from third right side discharging portion 234 is stored in second storage 226.

On the other hand, at time T4, the controller shift third storage 236 and first storage 216 from the closed state of closing path 26 to the opened state of opening path 26. Herewith, the medicine stored in third storage 236 is received by second storage 226, and is stored in second storage 226 together with the medicine discharged from third right side discharging portion 234. The medicine stored in first storage 216 drops toward first floor 10, that is, hopper 13, together with the medicine discharged from first right side discharging portion 214.

The controller shifts third storage 236 and first storage 216 to the opened state, and then shifts them to the closed state again. At time T5, third storage 236 and first storage 216 close path 26.

By the above operation, the medicines in the first package including the medicine stored in fifth right side tablet case 252, fourth left side tablet case 241, third right side tablet case 232, second left side tablet case 221, and first right side tablet case 212 are supplied toward packaging unit 15 of first floor 10.

At time T5, the controller starts outputting the driving signal to the driving portion provided in fourth left side discharging portion 243 and second left side discharging portion 223. The controller outputs the driving signal for a predetermined period, to drive the driving portion. Herewith, fourth left side discharging portion 243 and second left side discharging portion 223 discharge the medicine stored inside fourth left side tablet case 241 and second left side tablet case 221 toward path 26. At this time, the medicine discharged from fourth left side tablet case 241 is a medicine to be packed in the third package in packaging unit 15. The medicine discharged from second left side tablet case 221 is a medicine to be packed in the second package in packaging unit 15.

After the controller starts outputting the driving signal, until the medicine discharged from fourth left side discharging portion 243 and the medicine discharged from second left side discharging portion 223 reach the position where third storage 236 is disposed and the position where first storage 216 is disposed respectively, third storage 236 and first storage 216 are maintained in the closed state of closing path 26 (see the diagram (3) of FIG. 3). Herewith, the medicine discharged from fourth left side discharging portion 243 is stored in third storage 236. The medicine discharged from second left side discharging portion 223 is stored in first storage 216.

On the other hand, at time T5, the controller shift fourth storage 246 and second storage 226 from the closed state of closing path 26 to the opened state of opening path 26. Herewith, the medicine stored in fourth storage 246 is received by third storage 236, and is stored in third storage 236 together with the medicine discharged from fourth left side discharging portion 243. The medicine stored in second storage 226 is received by first storage 216 and stored in first storage 216 together with the medicine discharged from second left side discharging portion 223.

The controller shifts fourth storage 246 and second storage 226 to the opened state, and then shifts them to the closed state again. At time T6, fourth storage 246 and second storage 226 close path 26.

At time T6, the controller starts outputting the driving signal to the driving portion provided in fifth right side discharging portion 254, third left side discharging portion 233, and first left side discharging portion 213. The controller outputs the driving signal for a predetermined period, to drive the driving portion. Herewith, fifth right side discharging portion 254, third left side discharging portion 233, and first left side discharging portion 213 discharge the medicine stored in the interior of fifth right side tablet case 252, third left side tablet case 231, and first left side tablet case 211 toward path 26, respectively. At this time, the medicine discharged from fifth right side tablet case 252 is a medicine to be packaged in the fourth package in packaging unit 15. The medicine discharged from third left side tablet case 231 is a medicine to be packaged in the third package in packaging unit 15. The medicine discharged from first left side tablet case 211 is a medicine to be packaged in the second package in packaging unit 15.

After the controller starts outputting the driving signal, until the medicine discharged from fifth right side discharging portion 254 and the medicine discharged from third left side discharging portion 233 reach the position where fourth storage 246 is disposed and the position where second storage 226 is disposed respectively, fourth storage 246 and second storage 226 are maintained in the closed state of closing path 26. Herewith, the medicine discharged from fifth right side discharging portion 254 is stored in fourth storage 246. The medicine discharged from third left side discharging portion 233 is stored in second storage 226.

On the other hand, at time T6, the controller shifts third storage 236 and first storage 216 from the closed state of closing path 26 to the opened state of opening path 26. Herewith, the medicine stored in third storage 236 is received by second storage 226, and is stored in second storage 226 together with the medicine discharged from third left side discharging portion 233. The medicine stored in first storage 216 drops toward first floor 10, that is, hopper 13, together with the medicine discharged from first left side discharging portion 213.

The controller shifts third storage 236 and first storage 216 to the opened state, and then shifts them to the closed state again. At time T7, third storage 236 and first storage 216 close path 26.

By the above operation, the medicines in the second package including the medicine stored in fifth right side tablet case 252, fourth left side tablet case 241, third right side tablet case 232, second left side tablet case 221, and first left side tablet case 211 is supplied toward packaging unit 15 of first floor 10.

Second floor 20 repeats the same operation after that, so that medicine packaging apparatus 1 can package the medicine designated in the prescription.

In the above-described embodiment, the medicine included in the second package and third package is discharged from each discharging portion, before the medicine included in the first package is discharged from fifth discharging portion disposed at the most upstream side and reaches packaging unit 15 of first floor 10. That is, the discharge of the medicine included in the second package and the third package is started, before the time required for the medicine included in the first package to reach packaging unit 15 elapses. Therefore, medicine packaging apparatus 1 can shorten the time interval for supplying the medicine to the packaging paper, as compared with a conventional medicine supplying apparatus in which the medicine included in the second packaging is discharged after the medicine included in the first packaging discharged from the discharging portion disposed at the most upstream reaches packaging unit 15. As a result, it is possible to shorten the time for packaging the medicine.

In the present embodiment, the medicine discharged from one discharging portion drops toward first floor 10 while forming a group together with the medicine discharged from the other discharging portion. The medicine is stored in each storage for each group to which the medicine belongs. Therefore, the medicines belonging to one group and the medicines belonging to the other group are reliably separated, and the medicines belonging to the other group are not mixed in one group.

Each storage is disposed closer to a discharging portion disposed adjacent to an upstream side between a discharging portion disposed adjacent to an upstream side and a discharging portion disposed adjacent to a downstream side.

This is due to the following reasons. When each discharging portion discharges the medicine, a slight variation may occur in the time after each discharging portion starts the discharging operation until the medicine is discharged. That is, a slight time lag may occur with respect to a period from the start of the discharging operation by each discharging portion to completion of the discharging of the medicine. In this case, when the storage is disposed closer to the discharging portion disposed adjacent to the downstream side than the discharging portion disposed adjacent to the upstream side, there is a possibility that it takes time for the medicine discharged from the discharging portion to reach the storage disposed adjacent to the downstream side, and the opening and closing operation of the storage on the downstream side is completed before the medicine reaches the storage of the downstream side. In this case, medicines belonging to one group are mixed into another group.

On the other hand, in the present embodiment, each storage is disposed closer to the discharging portion disposed adjacent to the upstream side between the discharging portion disposed adjacent to the upstream side and the discharging portion disposed adjacent to the downstream side. Therefore, even when a slight time lag occurs with respect to a period from the start of the discharging operation of the medicine by the discharging portion to completion of the discharging of the medicine, the medicine reaches the storage on the downstream side in a short time, so that the opening and closing operation of the storage on the downstream side is not completed before the medicine discharged from the discharging portion reaches the storage on the downstream side. As a result, it is possible to prevent from being mixed the medicines included in one group with the medicines included in the other group.

In the embodiment described above, third storage 236 and first storage 216 are shifted to the opened state at the timing when fourth storage 246 and second storage 226 shift to the closed state.

However, the timing of shifting third storage 236 and first storage 216 to the opened state may be earlier or later than the timing when fourth storage 246 and second storage 226 shift to the closed state, in the case that the medicines included in the respective groups are not mixed. The timing when the medicine is discharged from each of the discharging portions (the fifth discharging portion, the third discharging portion, and the first discharging portion) may be earlier or later than the timing when third storage 236 and first storage 216 shift to the opened state.

In the embodiment described above, fourth storage 246 and second storage 226 are shifted to the opened state at the timing when third storage 236 and first storage 216 are shifted to the closed state.

However, the timing of shifting fourth storage 246 and second storage 226 to the opened state may be earlier or later than the timing when third storage 236 and first storage 216 shift to the closed state, in the case that the medicines included in the respective groups are not mixed. The timing when the medicine is discharged from each of the discharging portions (the fourth discharging portion and the second discharging portion) may be earlier or later than the timing when fourth storage 246 and second storage 226 are shifted to the opened state.

In the embodiment described above, first floor 10 and second floor 20 are integrally formed. However, first floor 10 and second floor 20 may be formed separately and each of them may be individually used. For example, second floor 20, that is, the medicine supplying apparatus may be used in combination with other apparatuses.

Embodiment 2

Figure 4:
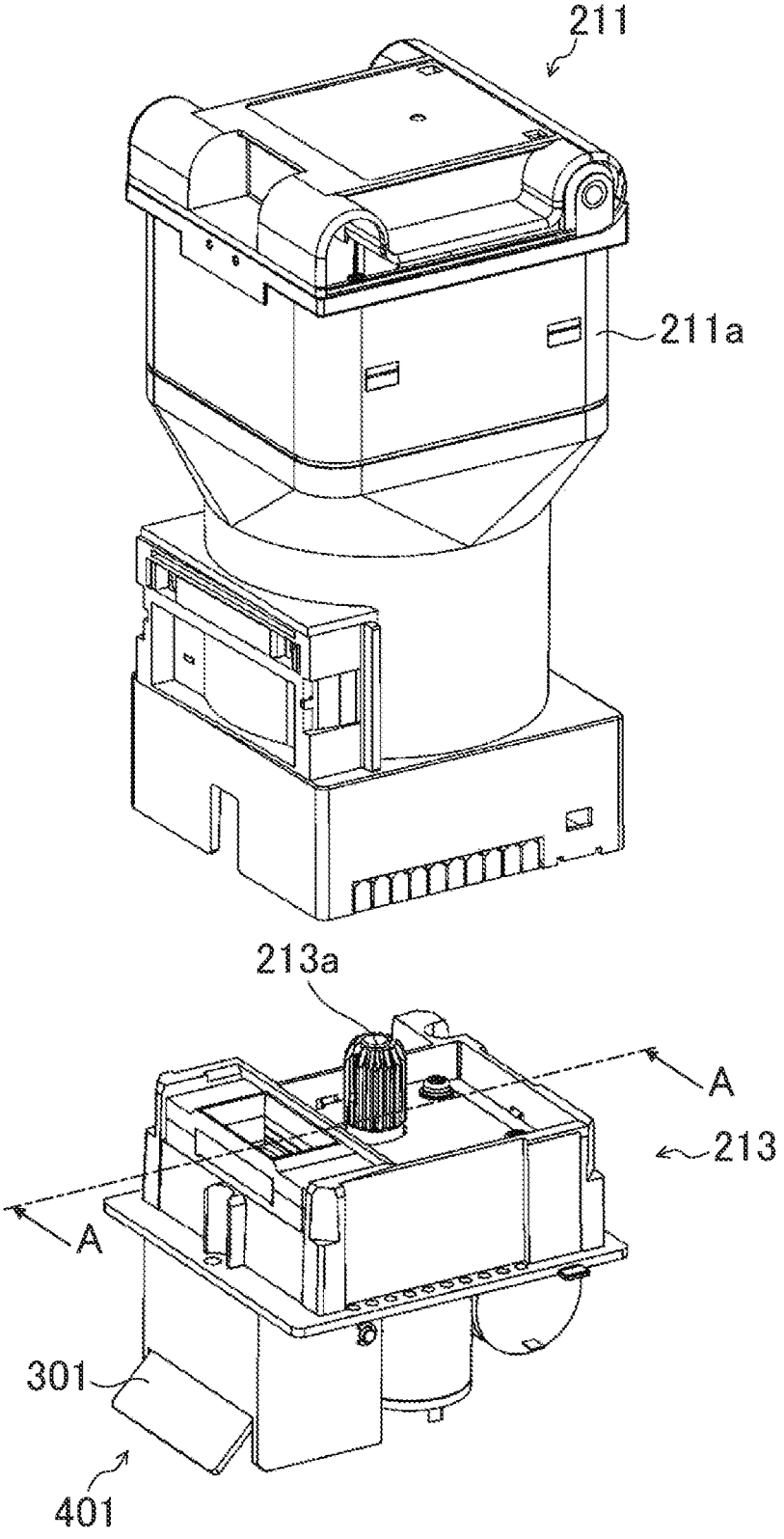
FIG. 4 is a diagram illustrating an example of the appearance of the tablet case, the discharging portion, and the shutter portion according to Embodiment 2.
Figure 5:
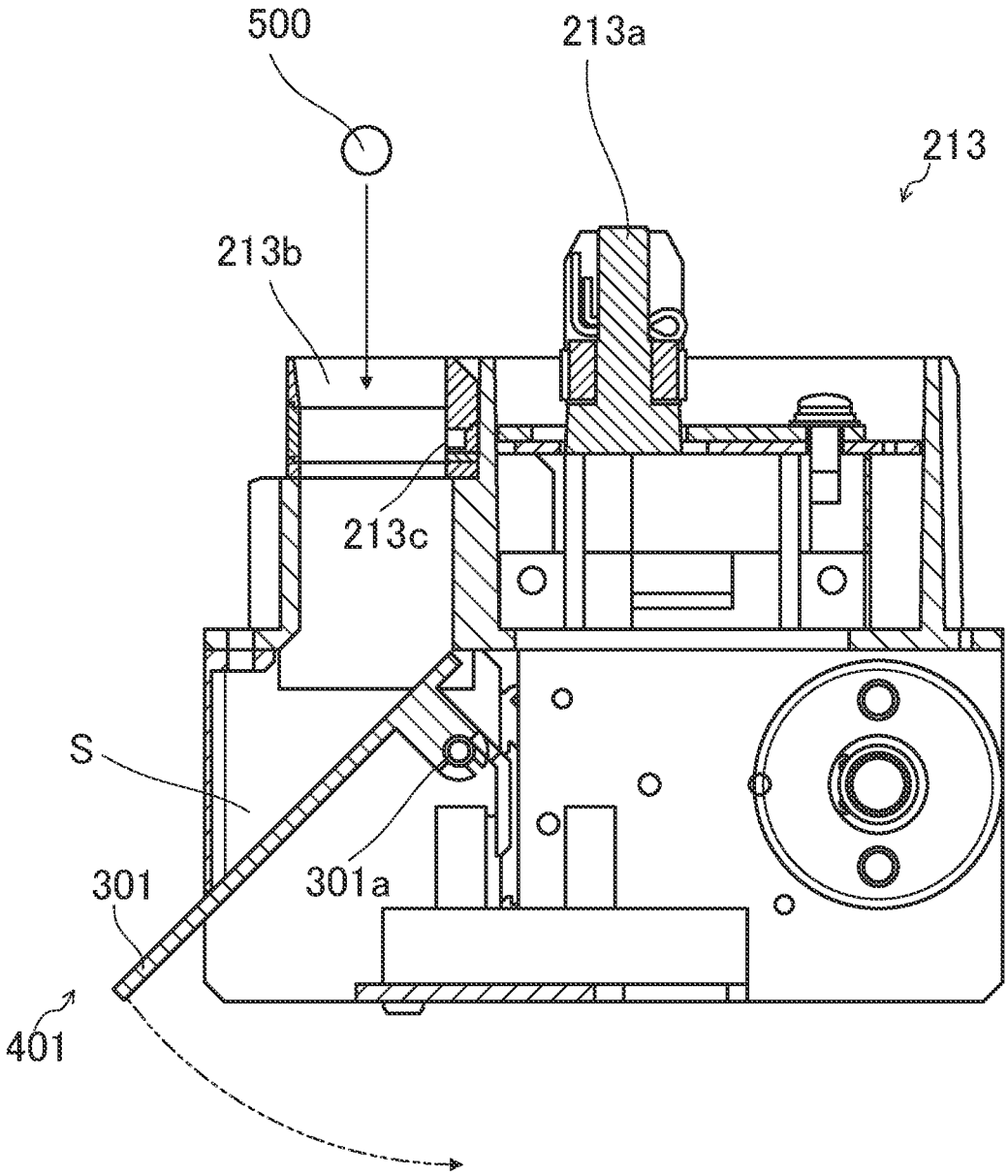
FIG. 5 is an A-A cross-sectional view of the discharging portion and the shutter portion illustrated in FIG. 4.

Hereinafter, Embodiment 2 of the present invention will be described with reference to FIGS. 4 to 6. In the embodiment described below, the same reference numerals are assigned to the portions exhibiting the same effect as those of Embodiment 1 described above, and the description thereof is omitted. In the following description, points different from those of Embodiment 1 will be mainly described.

Second floor 20 in Embodiment 1 has a discharging portion corresponding to each tablet case. On the other hand, in second floor 20 in Embodiment 2, a discharging portion and a shutter portion corresponding to each tablet case is provided. In other words, in second floor 20, the shutter portion is provided corresponding to each discharging portion. Note that the configuration of the shutter portion provided on second floor 20 is all the same. The shutter portion temporarily stores the medicine discharged from the tablet case by the discharging portion and directed to path 26. At a predetermined timing, the shutter portion discharges the stored medicine toward path 26. The shutter portion will be described in detail later.

Hereinafter, with reference to FIGS. 4 and 5, the structure of the tablet case, the discharging portion, and the shutter portion of Embodiment 2 will be described with reference to first left side tablet case 211, first left side discharging portion 213, and first left side shutter portion 401 provided corresponding to first left side tablet case 211, as an example. FIG. 4 illustrates an example of the appearance of first left side tablet case 211, first left side discharging portion 213, and first left side shutter portion 401 according to Embodiment 2. FIG. 5 is an A-A cross-sectional view of first left side discharging portion 213 and first left side shutter portion 401 illustrated in FIG. 4.

First left side tablet case 211 has storage section 211*a*. The medicine is stored inside storage section 211*a*.

First left side discharging portion 213 has driving portion 213*a*, discharging path 213*b*, and medicine detecting sensor 213*c*.

Driving portion 213*a* has a motor and/or the like, and is connected to a medicine discharging mechanism disposed inside storage section 211*a*. When driving portion 213*a* is driven by the controller, medicine 500 is discharged one by one from storage section 211*a*. Discharging path 213*b* is a path through which medicine 500 discharged from storage section 211*a* passes, and communicates with path 26.

Medicine detecting sensor 213*c* is, for example, an optical sensor including alight projecting portion and a light receiving portion, and detects that medicine 500 passes through discharging path 213*b* by detecting that the light emitted from the light projecting portion to the light receiving portion is blocked by medicine 500.

First left side shutter portion 401 has first left side shutter 301, shaft 301*a*, and a shutter driving portion (not illustrated).

First left side shutter 301 is attached to shaft 301*a*. Shaft 301*a* is a rotatable shaft extending in the horizontal direction. The shutter driving portion receives a signal from the controller and drives to rotate shaft 301*a* around the center axis of shaft 301*a*.

Normally, first left side shutter 301 blocks discharging path 213*b*. First left side shutter 301 blocks (that is, closes) discharging path 213*b*, so that storage space S is formed. When a signal indicating an opening instruction (hereinafter, referred to as an opening signal) is output from the controller, the shutter driving portion is driven to rotate shaft 301*a* around the central axis of shaft 301*a* and counterclockwise. First left side shutter 301 rotates around shaft 301*a* as indicated by the two-dot chain line arrow in accordance with the rotation of shaft 301*a* to open discharging path 213*b*. When a signal indicating a closing instruction (hereinafter, referred to as a closing signal) is output from the controller, the shutter driving portion is driven to rotate shaft 301*a* around the central axis of shaft 301*a* and clockwise. First left side shutter 301 rotates around shaft 301*a* in the direction opposite to the two-dot chain line arrow in accordance with the rotation of shaft 301*a*, herewith closing discharging path 213*b*.

Medicine 500 discharged from storage section 211*a* drops into discharging path 213*b* and is stored in storage space S. When discharging path 213*b* is opened, medicine 500 stored in storage space S is discharged to path 26 leading to hopper 13.

The second, third, fourth, and fifth left side shutter portions are provided on second floor 20 corresponding to second, third, fourth, and fifth left side tablet cases 221, 231, 241, and 251. The second, third, fourth, and fifth left side shutter portions have second, third, fourth, and fifth left side shutters 302, 303, 304, and 305, respectively. The first, second, third, fourth, and fifth right side shutter portions are provided on second floor 20 corresponding to first, second, third, fourth, and fifth right side tablet cases 212, 222, 232, 242, and 252. The first, second, third, fourth, and fifth right side shutter portions have first, second, third, fourth, and fifth right side shutters 311, 312, 313, 314, and 315, respectively.

Figure 6:
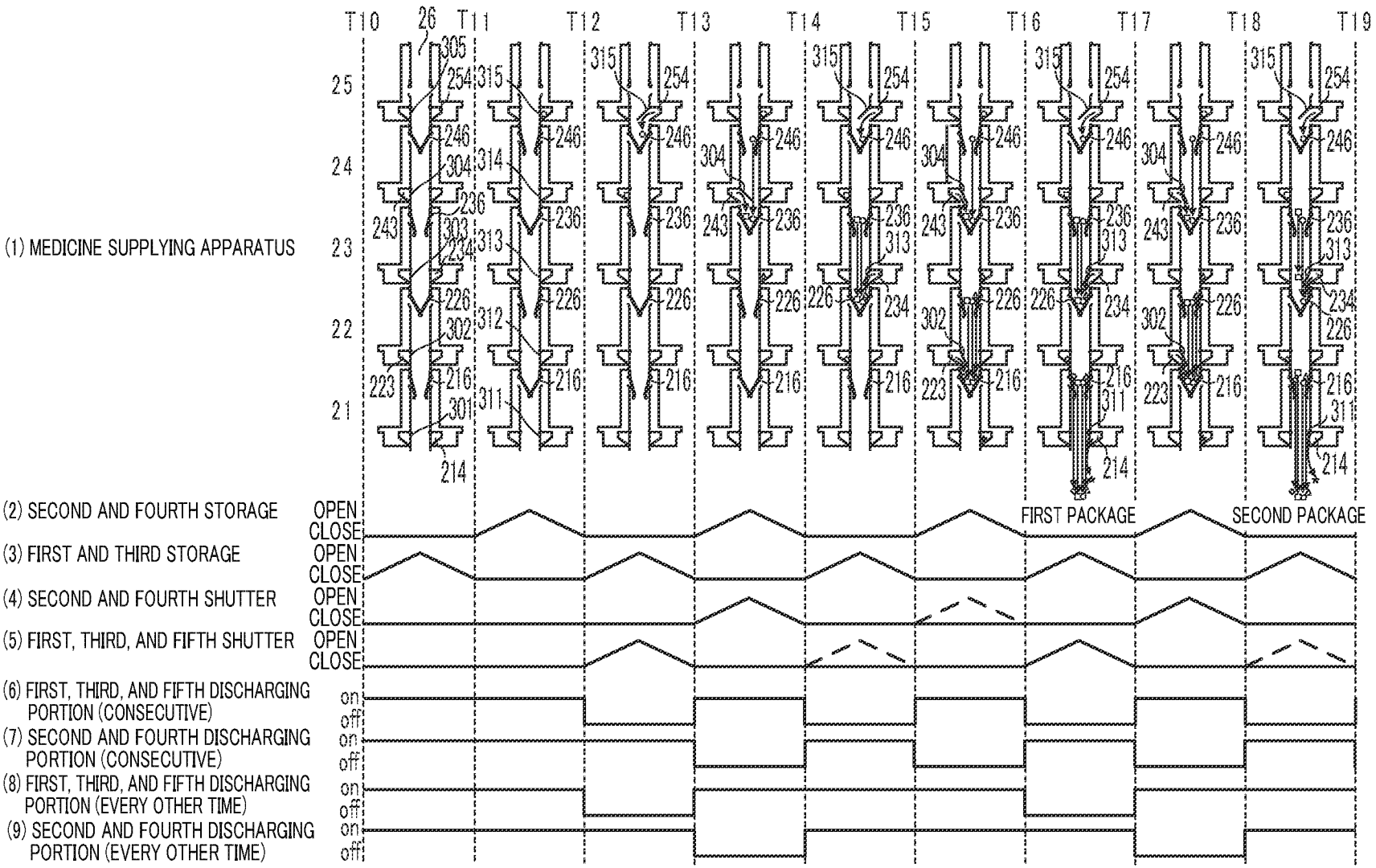
FIG. 6 is a diagram illustrating an example of an operation of a second floor according to Embodiment 2.

FIG. 6 is a diagram for explaining an example of the operation of second floor 20 according to Embodiment 2. Hereinafter, for easy understanding, it is assumed that the medicine is discharged from only the tablet case located closest to the front side among the plurality of tablet cases arranged in the depth direction in each drawer illustrated in FIG. 2.

The diagram (1) of FIG. 6 illustrates a state in which the medicine stored by closing each shutter is discharged to path 26 by opening each shutter, a state in which the medicine discharged to path 26 by opening each shutter drops in path 26, and a state in which the medicine dropping in path 26 is stored in each storage, in time series from the left side to the right side.

The diagram (2) of FIG. 6 illustrates an opened and closed state of second storage 226 and fourth storage 246. The diagram (3) of FIG. 6 illustrates the opened and closed state of first storage 216 and third storage 236.

The diagram (4) of FIG. 6 illustrates the opened and closed state of second left side shutter 302 and fourth left side shutter 304. The diagram (5) of FIG. 6 illustrates the opened and closed state of first right side shutter 311, third right side shutter 313, and fifth right side shutter 315. The diagrams (6) and (8) of FIG. 6 illustrate the driving state of first right side discharging portion 214, third right side discharging portion 234, and fifth right side discharging portion 254. The diagrams (7) and (9) of FIG. 6 illustrate a driving state of second left side discharging portion 223 and fourth left side discharging portion 243.

However, the diagram (6) illustrates the driving state of each right side discharging portion in the case where first right side discharging portion 214, third right side discharging portion 234, and fifth right side discharging portion 254 continuously perform the discharging operation of the medicine. On the other hand, the diagram (8) illustrates the driving state of each right side discharging portion in the case where first right side discharging portion 214, third right side discharging portion 234, and fifth right side discharging portion 254 discharge the medicine every other time. Performing the discharging operation of the medicine continuously means, for example, fifth right side discharging portion 254 discharges the medicine to be included as the first package and the medicine to be included as the second package. Discharging the medicine every other time means, for example, fifth right side discharging portion 254 discharges the medicine to be wrapped in the odd number, and fifth right side discharging portion 254 does not discharge the medicine to be wrapped in the even number.

Similarly, the diagram (7) illustrates the driving state of each left side discharging portion in the case where second left side discharging portion 223 and fourth left side discharging portion 243 continuously perform the discharging operation of the medicine. The diagram (9) illustrates the driving state of each left side discharging portion in the case where second left side discharging portion 223 and fourth left side discharging portion 243 discharge the medicine every other time.

Note that, in the diagrams (6) and (8) of FIG. 6, when being the "on state", at least one driving portion of first right side discharging portion 214, third right side discharging portion 234, and fifth right side discharging portion 254 is driven. When being the "off state", each driving portion of first right side discharging portion 214, third right side discharging portion 234, and fifth right side discharging portion 254 is not driven. In the diagrams (7) and (9), when being the "on state", at least one driving portion of second left side discharging portion 223 and fourth left side discharging portion 243 is driven, when being "the off state", each of driving portion of second left side discharging portion 223 and fourth left side discharging portion 243 is not driven.

Hereinafter, the operations illustrated in the diagrams (1) to (7) will be referred to as a consecutive discharging operation, and the operations illustrated in the diagrams (1)

to (5), (8) and (9) will be referred to as an every other time discharging operation. First, the consecutive discharging operation will be described, and next, the every other time discharging operation will be described.

[Consecutive Discharging Operation]

First, at time T10, the controller, starts outputting a driving signal to the driving portion provided in fifth right side discharging portion 254. The controller outputs the driving signal for a predetermined period, to drive the driving portion. Herewith, the medicine stored inside fifth right side tablet case 252 is discharged toward fifth right side discharging portion 254. Here, the controller can drive the driving portion of fifth right side discharging portion 254 up to time T12, at most (see the diagram (6) of FIG. 6). At this time, the medicine discharged toward fifth right side discharging portion 254 is a medicine to be packaged in the first package in packaging unit 15

During time T10 to time T12, the controller maintains fifth right side shutter 315 in the closed state in which the discharging path is closed (see the diagram (5) of FIG. 6). Herewith, the medicine discharged toward fifth right side discharging portion 254 is stored in a storage space formed by closing the discharging path by fifth right side shutter 315.

At time T10, the controller starts outputting the driving signal to the driving portion provided in fourth left side discharging portion 243. The controller outputs the driving signal for a predetermined period, to drive the driving portion. Herewith, the medicine stored inside fourth left side tablet case 241 is discharged toward fourth left side discharging portion 243 Here, the controller can drive the driving portion of fourth left side discharging portion 243 up to time T13, at most (see the diagram (7) of FIG. 6). At this time, the medicine discharged toward fourth left side discharging portion 243 is a medicine to be packaged in the first package in packaging unit 15.

During time T10 to time T13, the controller maintains fourth left side shutter 304 in the closed state in which the discharging path is closed (see the diagram (4) of FIG. 6). Herewith, the medicine discharged toward fourth left side discharging portion 243 is stored in the storage space formed by closing the discharging path by fourth left side shutter 304.

At time T10, the controller shifts third storage 236 and first storage 216 from the closed state of closing path 26 to the opened state of opening path 26 (see the diagram (3) of FIG. 6).

Thereafter, the controller shifts third storage 236 and first storage 216 from the opened state of opening path 26 to the closed state of closing path 26 (see the diagram (3) of FIG. 6). At time T11, third storage 236 and first storage 216 close path 26.

At time T10 to time T11, the controller maintains fourth storage 246 and second storage 226 in the closed state of closing path 26 (see the diagram (2) of FIG. 6).

At time T11, the controller shifts fourth storage 246 and second storage 226 from the closed state of closing path 26 to the opened state of opening path 26 (see the diagram (2) of FIG. 6).

Thereafter, the controller shifts fourth storage 246 and second storage 226 from the opened state of opening path 26 to the closed state of closing path 26 (see the diagram (2) of FIG. 6). At time T12, fourth storage 246 and second storage 226 close path 26. Herewith, fourth storage 246 is brought into a state in which the medicines to be packaged in the first package can be stored.

At time T11 to time T12, the controller maintains third storage 236 and first storage 216 in the closed state of closing path 26 (see the diagram (3) of FIG. 6).

By time T12, the medicine inside fifth right side tablet case 252 needs to be discharged toward fifth right side discharging portion 254. Therefore, the controller drives the driving portion of fifth right side discharging portion 254 until the medicine is discharged toward fifth right side discharging portion 254. The controller stops the driving of the driving portion when the medicine detecting sensor of fifth right side discharging portion 254 detects that the specified number of medicines have passed through the discharging path. The diagram (6) of FIG. 6 illustrates a state in which the specified number of medicines have passed through the discharging path at time T12, and the driving of the driving portion has stopped. The controller may stop the driving of the driving portion of fifth right side discharging portion 254 at a predetermined timing at which the specified number of medicines can be expected to pass through the discharging path, for example, at time T12.

At time T12, the controller outputs the opening signal to the shutter driving portion of fifth right side discharging portion 254, to shift fifth right side shutter 315 from the closed state of closing the discharging path to the opened state of opening the discharging path (see the diagram (5) of FIG. 6). Herewith, the medicine stored in the storage space formed by closing the discharging path by fifth right side shutter 315 is discharged toward path 26.

Thereafter, the controller outputs the closing signal to the shutter driving portion of fifth right side discharging portion 254, to shift fifth right side shutter 315 from the opened state of opening the discharging path to the closed state of closing the discharging path (see the diagram (5) of FIG. 6). Herewith, fifth right side shutter 315 is brought into a state in which the medicine to be packaged in the next package (here, the second package) can be stored.

At time T12 to time T13, the controller maintains fourth storage 246 and second storage 226 in the closed state of closing path 26 (see the diagram (2) of FIG. 6). Herewith, the medicine discharged toward path 26 by opening the discharging path by fifth right side shutter 315 is stored in fourth storage 246.

At time T12, the controller shifts third storage 236 and first storage 216 from the closed state of closing path 26 to the opened state of opening path 26 (see the diagram (3) of FIG. 6).

Thereafter, the controller shifts third storage 236 and first storage 216 from the opened state of opening path 26 to the closed state of closing path 26 (see the diagram (3) of FIG. 6). At time T13, third storage 236 and first storage 216 close path 26. Herewith, third storage 236 is brought into a state in which the medicine to be packaged in the first package can be stored.

By time T13, the medicine inside fourth left side tablet case 241 needs to be discharged toward fourth left side discharging portion 243. Therefore, the controller drives the driving portion of fourth left side discharging portion 243 until the medicine is discharged toward fourth left side discharging portion 243. The controller stops the driving of the driving portion when the medicine detecting sensor of fourth left side discharging portion 243 detects that the specified number of medicines have passed through the discharging path. The diagram (7) of FIG. 6 illustrates a state in which the specified number of medicines have passed through the discharging path, and the driving of the driving portion has been stopped, at time T13. The controller may stop the driving of the driving portion of fourth left side discharging portion 243 at a predetermined timing at which the specified number of medicines can be expected to pass through the discharging path, for example, at time T13 (see the diagram (7) of FIG. 6).

At time T13, the controller outputs the opening signal to the shutter driving portion of fourth left side discharging portion 243, to shift fourth left side shutter 304 from the closed state of closing the discharging path to shift the opened state of opening the discharging path (see the diagram (4) of FIG. 6). Herewith, the medicine stored in the storage space formed by closing the discharging portion by fourth left side shutter 304 is discharged toward path 26.

Thereafter, the controller outputs the closing signal to the shutter driving portion of fourth left side discharging portion 243, to shift fourth left side shutter 304 from the opened state of opening the discharging path to the closed state of closing the discharging path (see the diagram (4) of FIG. 6). Herewith, fourth left side shutter 304 is brought into s state in which the medicine to be packaged in the next pack (the second pack) can be stored.

At time T13, the controller starts outputting a driving signal to each driving portion provided in fifth right side discharging portion 254 and third right side discharging portion 234. Herewith, the medicine stored inside fifth right side tablet case 252 and third right side tablet case 232 is discharged toward fifth right side discharging portion 254 and third right side discharging portion 234, respectively. Here, the controller can drive each driving portion of fifth right side discharging portion 254 and third right side discharging portion 234 up to time T14, at most (see the diagram (6) of FIG. 6). At this time, the medicine discharged toward fifth right side discharging portion 254 is a medicine to be packaged in the second package in packaging unit 15. The medicine discharged toward third right side discharging portion 234 is a medicine to be packaged in the first package in packaging unit 15

During time T13 to time T14, the controller maintains fifth right side shutter 315 and third right side shutter 313 in the closed state in which the discharging path is closed (see the diagram (5) of FIG. 6). Herewith, the medicine discharged toward fifth right side discharging portion 254 is stored in the storage space formed by closing the discharging path by fifth right side shutter 315. The medicine discharged toward third right side discharging portion 234 is stored in the storage space formed by closing the discharging path by third right side shutter 313.

At time T13, the controller shifts fourth storage 246 and second storage 226 from the closed state of closing path 26 to the opened state of opening path 26 (see the diagram (2) of FIG. 6). Herewith, the medicine stored in fourth storage 246 drops toward third storage 236.

Thereafter, the controller shifts fourth storage 246 and second storage 226 from the opened state of opening path 26 to the closed state of closing path 26 (see the diagram (2) of FIG. 6). At time T14, fourth storage 246 and second storage 226 close path 26. Herewith, fourth storage 246 is brought into a state in which the medicine to be packaged in the next package (here, the second package) can be stored. Second storage 226 in brought into a state in which the medicine to be packaged in the first package can be stored.

At time T13 to time T14, the controller maintains third storage 236 and first storage 216 in the closed state of closing path 26 (see the diagram (3) of FIG. 6). Herewith, the medicine discharged toward path 26 by opening the discharging path by fourth left side shutter 304 and the medicine stored in fourth storage 246 are received by third storage 236 and stored in third storage 236.

By time T14, the medicine inside fifth right side tablet case 252 and third right side tablet case 232 needs to be discharged toward fifth right side discharging portion 254 and third right side discharging portion 234, respectively. Therefore, the controller drives the driving portion of fifth right side discharging portion 254 until the medicine is discharged toward fifth right side discharging portion 254, and drives the driving portion of third right side discharging portion 234 until the medicine is discharged toward third right side discharging portion 234. The controller stops the driving of the driving portion of fifth right side discharging portion 254 when the medicine detecting sensor of fifth right side discharging portion 254 detects that the specified number of medicines have passed through the discharging path. Similarly, the controller stops the driving of the driving portion of third right side discharging portion 234 when the medicine detecting sensor of third right side discharging portion 234 detects that the specified number of medicines have passed through the discharging path. The diagram (6) of FIG. 6 illustrates a state in which the specified number of medicines have passed through the discharging path and the driving of the driving portion of fifth right side discharging portion 254 and the driving portion of third right side discharging portion 234 have been stopped, at time T14. The controller may stop the driving of driving portion of fifth right side discharging portion 254 and the driving of the driving portion of the of third right side discharging portion 234 at a predetermined timing at which the specified number of medicines can be expected to pass through the discharging path, for example, at time T14.

At time T14, the controller outputs the opening signal to the shutter driving portion of fifth right side discharging portion 254 and third right side discharging portion 234, to shift fifth right side shutter 315 and third right side shutter 313 from the closed state of closing the discharging path to the opened state of opening the discharging path, respectively (see broken line in the diagram (5) of FIG. 6). Herewith, each medicine stored in the storage space formed by closing the discharging path by fifth right side shutter 315 and the storage space formed by closing the discharging path by third right side shutter 313 is discharged toward path 26.

Thereafter, the controller outputs the closing signal to the shutter driving portion of fifth right side discharging portion 254 and third right side discharging portion 234, to shift fifth right side shutter 315 and third right side shutter 313 from the opened state of opening the discharging path to the closed state of closing the discharging path (see broken line in the diagram (5) of FIG. 6). Herewith, fifth right side shutter 315 is brought into a state in which the medicine to be packaged in the next package (here, the third package) can be stored. Third right side shutter 313 is brought into a state in which the medicine to be packaged in the next package (here, the second package) can be stored.

At time T14, the controller starts outputting the driving signal to each driving portion provided in fourth left side discharging portion 243 and second left side discharging portion 223. Herewith, the medicine stored inside fourth left side tablet case 241 and second left side tablet case 221 is discharged toward fourth left side discharging portion 243 and second left side discharging portion 223, respectively. Here, the controller can drive each driving portion of fourth left side discharging portion 243 and second left side discharging portion 223 up to time T15 at most (see the diagram (7) of FIG. 6). At this time, the medicine discharged toward fourth left side discharging portion 243 is a medicine to be packaged in the second package in packaging unit 15. The medicine discharged toward second left side discharging portion 223 is a medicine to be packaged in the first package in packaging unit 15

During time T14 to time T15, the controller maintains fourth left side shutter 304 and second left side shutter 302 in the closed state in which the discharging path is closed (see the diagram (4) of FIG. 6). Herewith, the medicine discharged toward fourth left side discharging portion 243 is stored in the storage space formed by closing the discharging path by fourth left side shutter 304. The medicine discharged toward second left side discharging portion 223 is stored in storage space formed by closing the discharging path by second left side shutter 302.

At time T14, the controller shifts third storage 236 and first storage 216 from the closed state of closing path 26 to the opened state of opening path 26 (see the diagram (3) of FIG. 6). Herewith, the medicine stored in third storage 236 drops toward second storage 226.

Thereafter, the controller shifts third storage 236 and first storage 216 from the opened state of opening path 26 to the closed state of closing path 26 (see the diagram (3) of FIG. 6). At time T15, third storage 236 and first storage 216 close path 26. Herewith, third storage 236 is brought into a state in which the medicine to be packaged in the next package (here, the second package) can be stored. First storage 216 is brought into a state in which the medicine to be packaged in the first package can be stored.

At time T14 to time T15, the controller maintains fourth storage 246 and second storage 226 in the closed state of closing path 26 (see the diagram (2) of FIG. 6). Herewith, the medicine discharged by opening the discharging path by third right side shutter 313 and the medicine stored in third storage 236 are received by second storage 226 and stored in second storage 226. The medicine discharged by opening the discharging path by fifth right side shutter 315 is stored in fourth storage 246.

By time T15, the medicine inside fourth left side tablet case 241 and second left side tablet case 221 needs to be discharged toward fourth left side discharging portion 243 and second left side discharging portion 223, respectively. Therefore, the controller drives the driving portion of fourth left side discharging portion 243 until the medicine is discharged toward fourth left side discharging portion 243, and drives the driving portion of second left side discharging portion 223 until the medicine is discharged toward second left side discharging portion 223. The controller stops the driving of the driving portion of fourth left side discharging portion 243 when the medicine detecting sensor of fourth left side discharging portion 243 detects that the specified number of medicines have passed through the discharging path. Similarly, the controller stops the driving of the driving portion of second left side discharging portion 223 when the medicine detecting sensor of second left side discharging portion 223 detects that the specified number of medicines have passed through the discharging path. The diagram (7) of FIG. 6 illustrates a state in which the specified number of medicines have passed through the discharging path, and the driving of the driving portion of fourth left side discharging portion 243, and the driving portion of second left side discharging portion 223 have stopped, at time T15. The controller may stop the driving of the driving portion of fourth left side discharging portion 243 and the driving of the driving portion of second left side discharging portion 223 at a predetermined timing at which the specified number of medicines can be expected to pass through the discharging path, for example, at time T15.

At time T15, the controller outputs the opening signal to the shutter driving portion of fourth left side discharging portion 243 and second left side discharging portion 223, to shift fourth left side shutter 304 and second left side shutter 302 from the closed state of closing the discharging path to the opened state of opening the discharging path, respectively (see broken line in the diagram (4) of FIG. 6). Herewith, each medicine stored in the storage space formed by closing the discharging path by fourth left side shutter 304 and the storage space formed by closing the discharging path by second left side shutter 302 is discharged toward path 26.

Thereafter, the controller outputs the closing signal to the shutter driving portion of fourth left side discharging portion 243 and second left side discharging portion 223, to shift fourth left side shutter 304 and second left side shutter 302 from the opened state of opening the discharging path to the closed state of closing the discharging path, respectively (see broken line in the diagram (4) of FIG. 6). Herewith, fourth left side shutter 304 is brought into a state in which the medicine to be packaged in the next package (here, the third package) can be stored. Second left side shutter 302 is brought into a state in which the medicine to be packaged in the next package (here, the second package) can be stored.

At time T15, the controller starts outputting the driving signal to each driving portion provided in fifth right side discharging portion 254, third right side discharging portion 234, and first right side discharging portion 214, respectively. Herewith, the medicine stored inside fifth right side tablet case 252, third right side tablet case 232, and first right side tablet case 212 is discharged toward fifth right side discharging portion 254, third right side discharging portion 234, and the first right side discharging portion 214, respectively. Here, the controller can drive each driving portion of fifth right side discharging portion 254, third right side discharging portion 234, and first right side discharging portion 214 up to time T16 at most (see the diagram (6) of FIG. 6). At this time, the medicine discharged toward fifth right side discharging portion 254 is a medicine packaged in the third package in packaging unit 15. The medicine discharged toward third right side discharging portion 234 is a medicine to be packaged in the second package in packaging unit 15. The medicine discharged toward first right side discharging portion 214 is a medicine to be packaged in the first package in packaging unit 15.

During time T15 to time T16, the controller maintains fifth right side shutter 315, third right side shutter 313, and first right side shutter 311 in the closed state in which the discharging path is closed (see the diagram (5) of FIG. 6). Herewith, the medicine discharged toward fifth right side discharging portion 254 is stored in the storage space formed by closing the discharging path by fifth left side shutter 305. The medicine discharged toward third right side discharging portion 234 is stored in the storage space formed by closing the discharging path by third right side shutter 313. The medicine discharged toward first right side discharging portion 214 is stored in the storage space formed by closing the discharging path by first right side shutter 311.

At time T15, the controller shifts fourth storage 246 and second storage 226 from the closed state of closing path 26 to the opened state of opening path 26 (see the diagram (2) of FIG. 6). Herewith, the medicine stored in fourth storage 246 drops toward third storage 236. The medicine stored in second storage 226 drops toward first storage 216.

Thereafter, the controller shifts fourth storage 246 and second storage 226 from the opened state of opening path 26 to the closed state of closing path 26 (see the diagram (2) of FIG. 6). At time T16, fourth storage 246 and second storage 226 close path 26. Herewith, fourth storage 246 is brought into a state in which the medicine to be packaged in the next package (here, the third package) can be stored. Second storage 226 is brought into a state in which the medicine to be packaged in the next package (here, the second package) can be stored.

At time T15 to time T16, the controller maintains third storage 236 and first storage 216 in the closed state of closing path 26 (see the diagram (3) of FIG. 6). Herewith, the medicine discharged toward path 26 by opening the discharging path by second left side shutter 302 and the medicine stored in second storage 226 are received by first storage 216 and stored in first storage 216. The medicine discharged toward path 26 by opening the discharging path by fourth left side shutter 304 and the medicine stored in fourth storage 246 are received by third storage 236 and stored in third storage 236.

By time T16, the medicines inside fifth right side tablet case 252, third right side tablet case 232, and first right side tablet case 212 need to be discharged toward fifth right side discharging portion 254, third right side discharging portion 234, and first right side discharging portion 214, respectively. Therefore, the controller drives the driving portion of fifth right side discharging portion 254 until the medicine is discharged toward fifth right side discharging portion 254, drives the driving portion of third right side discharging portion 234 until the medicine is discharged toward third right side discharging portion 234, and drives the driving portion of first right side discharging portion 214 until the medicine is discharged toward first right side discharging portion 214. The controller stops the driving of the driving portion of fifth right side discharging portion 254 when the medicine detecting sensor of fifth right side discharging portion 254 detects that the specified number of medicines have passed through the discharging path. Similarly, the controller stops the driving of the driving portion of third right side discharging portion 234 when the medicine detecting sensor of third right side discharging portion 234 detects that the specified number of medicines have passed through the discharging path. The controller stops the driving of the driving portion of first right side discharging portion 214 when the medicine detecting sensor of first right side discharging portion 214 detects that the specified number of medicines have passed through the discharging path. The diagram (6) of FIG. 6 illustrates a state in which the specified number of medicines have passed through the discharging path, the driving of the driving portion of fifth right side discharging portion 254, the driving portion of third right side discharging portion 234, the driving portion of first right side discharging portion 214 have stopped, at time T16. The controller may stop the driving of the driving portion of fifth right side discharging portion 254, the driving of the driving portion of third right side discharging portion 234, the driving of the driving portion of first right side discharging portion 214 at a predetermined timing at which the specified number of medicines can be expected to pass through the discharging path, for example, at time T16.

At time T16, the controller outputs the opening signal to the shutter driving portion of fifth right side discharging portion 254, third right side discharging portion 234, and first right side discharging portion 214, to shift fifth right side shutter 315, third right side shutter 313, and first right side shutter 311 from the closed state of closing the discharging path to shift the opened state of opening the discharging path, respectively (see diagram (5) of FIG. 6). Herewith, each medicine stored in the storage space formed by closing the discharging path by fifth right side shutter 315, the storage space formed by closing the discharging path by third right side shutter 313, and the storage space formed by closing the discharging path by first right side shutter 311 is discharged toward path 26.

Thereafter, the controller outputs the closing signal to the shutter driving portion of fifth right side discharging portion 254, third right side discharging portion 234, and first right side discharging portion 214, to shift fifth right side discharging portion 254, third right side discharging portion 234, and first right side discharging portion 214 from the opened state of opening the discharging path to the closed state of closing the discharging path, respectively (see the diagram (6) of FIG. 6). Herewith, fifth right side shutter 315 is brought into a state in which the medicine to be packaged in the next package (here, the fourth package) can be stored. Third right side shutter 313 is brought into a state in which the medicine to be packaged in the next package (here, the third package) can be stored. First right side shutter 311 is brought into a state in which the medicine to be packaged in the next package (here, the second package) can be stored.

At time T16, the controller starts outputting the driving signal to each driving portion provided in fourth left side discharging portion 243 and second left side discharging portion 223. Herewith, the medicine stored inside fourth left side tablet case 241 and second left side tablet case 221 is discharged toward fourth left side discharging portion 243 and second left side discharging portion 223, respectively. Here, the controller can drive each driving portion of fourth left side discharging portion 243 and second left side discharging portion 223 up to time T17 at most (see the diagram (7) of FIG. 6). At this time, the medicine discharged toward fourth left side discharging portion 243 is a medicine packaged in the third package in packaging unit 15. The medicine discharged toward second left side discharging portion 223 is a medicine to be packaged in the second package in packaging unit 15.

During time T16 to time T17, the controller maintains fourth left side shutter 304 and second left side shutter 302 in the closed state discharging path is closed (see the diagram (4) of FIG. 6). Herewith, the medicine discharged toward fourth left side discharging portion 243 is stored in the storage space formed by closing the discharging path by fourth left side shutter 304. The medicine discharged toward second left side discharging portion 223 is stored in storage space formed by closing the discharging path by second left side shutter 302.

At time T16, the controller shifts third storage 236 and first storage 216 from the closed state of closing path 26 to the opened state of opening path 26 (see FIG. 6 (3)). Herewith, the medicine stored in third storage 236 drops toward second storage 226. The medicine stored in first storage 216 drops toward hopper 13 together with the medicine discharged toward path 26 by opening the discharging path by first right side shutter 311.

By the above operation, the medicines in the first package including the medicine stored in fifth right side tablet case 252, fourth left side tablet case 241, third right side tablet case 232, second left side tablet case 221, and first right side tablet case 212 are supplied toward packaging unit 15 of first floor 10

Thereafter, the controller shifts third storage 236 and first storage 216 from the opened state of opening path 26 to the closed state of closing path 26 (see the diagram (3) of FIG. 6). At time T17, third storage 236 and first storage 216 close path 26. Herewith, third storage 236 is brought into a state in which the medicine to be packaged in the next package (here, the third package) can be stored. First storage 216 I brought into a state in which the medicine to be packaged in the next package (here, the second package) can be stored.

At time T16 to time T17, the controller maintains fourth storage 246 and second storage 226 in the closed state of closing path 26 (see the diagram (2) of FIG. 6). Herewith, the medicine discharged toward path 26 by opening the discharging path by third right side shutter 313 and the medicine stored in third storage 236 are received by second storage 226 and stored in second storage 226. The medicine discharged toward path 26 by opening the discharging path by fifth right side shutter 315 is received by fourth storage 246 is stored in fourth storage 246.

By time T17, the medicines inside fourth left side tablet case 241 and second left side tablet case 221 need to be discharged toward fourth left side discharging portion 243 and second left side discharging portion 223, respectively. The controller drives the driving portion of fourth left side discharging portion 243 until the medicine is discharged toward fourth left side discharging portion 243, and drives the driving portion of second left side discharging portion 223 until the medicine is discharged toward second left side discharging portion 223. The controller stops the driving of the driving portion of fourth left side discharging portion 243 when the medicine detecting sensor of fourth left side discharging portion 243 detects that the specified number of medicines have passed through the discharging path. Similarly, the controller stops the driving of the driving portion of second left side discharging portion 223 when the medicine detecting sensor of second left side discharging portion 223 detects that the specified number of medicines have passed through the discharging path. The diagram (7) of FIG. 6 illustrates a state in which the specified number of medicines have passed through the discharging path, the driving of the driving portion of fourth left side discharging portion 243 and the driving portion of second left side discharging portion 223 have stopped, at time T17. The controller may stop the driving of the driving portion of fourth left side discharging portion 243 and the driving portion of second left side discharging portion 223 at a predetermined timing at which the specified number of medicines can be expected to pass through the discharging path, for example, at time T17.

At time T17, the controller outputs an opening signal to the shutter driving portion of fourth left side discharging portion 243 and second left side discharging portion 223, to shift fourth left side shutter 304 and second left side shutter 302 from the closed state of closing the discharging path to the opened state of opening the discharging path, respectively (see the diagram (4) of FIG. 6). Herewith, each medicine stored in the storage space formed by closing the discharging path by fourth left side shutter 304 and the storage space formed by closing the discharging path by second left side shutter 302 is discharged toward path 26.

Thereafter, the controller outputs the closing signal to the shutter driving portion of fourth left side discharging portion 243 and second left side discharging portion 223, to shift fourth left side discharging portion 243 and second left side discharging portion 223 from the opened state of opening the discharging path to the closed state of closing the discharging path, respectively (see the diagram (4) of FIG. 6). Herewith, fourth left side shutter 304 is brought into a state in which the medicine to be packaged in the next package (here, the fourth package) can be stored. Second left side shutter 302 is brought into the medicine to be packaged in the next package (here, the third package) can be stored.

At time T17, the controller starts outputting the driving signal to each driving portion provided in fifth right side discharging portion 254, third right side discharging portion 234, and first right side discharging portion 214. Herewith, the medicine stored inside fifth right side tablet case 252, third right side tablet case 232, and first right side tablet case 212 is discharged toward fifth right side discharging portion 254, third right side discharging portion 234, and the first right side discharging portion 214, respectively. Here, the controller can drive each driving portion of fifth right side discharging portion 254, third right side discharging portion 234, and first right side discharging portion 214 up to time T18 at most (seethe diagram (6) of FIG. 6). At this time, the medicine discharged toward fifth right side discharging portion 254 is the medicine packaged in the fourth package in packaging unit 15. The medicine discharged toward third right side discharging portion 234 is a medicine to be packaged in the third package in packaging unit 15. The medicine discharged toward first right side discharging portion 214 is a medicine to be packaged in the second package in packaging unit 15.

During time T17 to time T18, the controller maintains fifth right side shutter 315, third right side shutter 313 and first right side shutter 311 in the closed state discharging path is closed (see the diagram (5) of FIG. 6). Herewith, the medicine discharged toward fifth right side discharging portion 254 is stored in a storage space formed by closing the discharging path by fifth left side shutter 305. The medicine discharged toward third right side discharging portion 234 is stored in a storage space formed by closing the discharging path by third right side shutter 313. The medicine discharged toward first right side discharging portion 214 is stored in the storage space formed by closing the discharging path by first right side shutter 311.

At time T17, the controller shifts fourth storage 246 and second storage 226 from the closed state of closing path 26 to the opened state of opening path 26 (see the diagram (2) of FIG. 6). Herewith, the medicine stored in second storage 226 drops toward first storage 216. The medicine stored in fourth storage 246 drops toward third storage 236.

Thereafter, the controller shifts fourth storage 246 and second storage 226 from the opened state of opening path 26 to the closed state of closing path 26 (see the diagram (2) of FIG. 6). At time T18, fourth storage 246 and second storage 226 close path 26. Herewith, fourth storage 246 is brought into a state in which the medicine to be packaged in the next package (here, fourth package) can be stored. Second storage 226 is brought into a state in which the medicine to be packaged in the next package (here, the third package) can be stored.

At time T17 to time T18, the controller maintains third storage 236 and first storage 216 in the closed state of closing path 26 (see the diagram (3) of FIG. 6). Herewith, the medicine discharged toward path 26 by opening the discharging path by second left side shutter 302 and the medicine stored in second storage 226 are received by first storage 216 and stored in first storage 216. The medicine discharged toward path 26 by opening the discharging path by fourth left side shutter 304 and the medicine stored in fourth storage 246 are received by third storage 236 and stored in third storage 236.

By time T18, the medicines inside fifth right side tablet case 252, third right side tablet case 232, and first right side tablet case 212 need to be discharged toward fifth right side discharging portion 254, third right side discharging portion 234, and first right side discharging portion 214, respectively. The controller drives the driving portion of fifth right side discharging portion 254 until the medicine is discharged toward fifth right side discharging portion 254, drives the driving portion of third right side discharging portion 234 until the medicine is discharged toward third right side discharging portion 234, and drives the driving portion of first right side discharging portion 214 until the medicine is discharged toward first right side discharging portion 214. The controller stops the driving of the driving portion of fifth right side discharging portion 254 when the medicine detecting sensor of fifth right side discharging portion 254 detects that the specified number of medicines have passed through the discharging path. Similarly, the controller stops the driving of the driving portion of third right side discharging portion 234 when the medicine detecting sensor of third right side discharging portion 234 detects that the specified number of medicines have passed through the discharging path. The controller stops the driving of the driving portion of first right side discharging portion 214 when the medicine detecting sensor of first right side discharging portion 214 detects that the specified number of medicines have passed through the discharging path. The diagram (6) of FIG. 6 illustrates a state in which the specified number of medicines passes through the discharging path, the driving portion of fifth right side discharging portion 254, the driving portion of third right side discharging portion 234, and the driving of the driving portion of first right side discharging portion 214 have stopped, at time T18. The controller may stop the driving of the driving portion of fifth right side discharging portion 254, the driving of the driving portion of third right side discharging portion 234, and the driving portion of first right side discharging portion 214 at a predetermined timing at which the specified number of medicines can be expected to pass through the discharging path, for example, at time T18.

At time T18, the controller outputs the opening signal to the shutter driving portion of fifth right side discharging portion 254, third right side discharging portion 234, and first right side discharging portion 214, to shift fifth right side shutter 315, third right side shutter 313 and first right side shutter 311 from the closed state of closing the discharging path to the opened state of opening the discharging path, respectively (see broken line in the diagram (5) of FIG. 6). Herewith, each medicine stored in the storage space formed by closing the discharging path by fifth right side shutter 315, the storage space formed by closing the discharging path by third right side shutter 313, and the storage space formed by closing the discharging path by first right side shutter 311 is discharged toward path 26.

Thereafter, the controller outputs the closing signal to the shutter driving portion of fifth right side discharging portion 254, third right side discharging portion 234, and first right side discharging portion 214, to shift fifth right side discharging portion 254, third right side discharging portion 234 and first right side discharging portion 214 from the opened state of opening the discharging path to the closed state of closing the discharging path, respectively (see broken line in the diagram (5) of FIG. 6). Herewith, fifth right side shutter 315 is brought into a state in which the medicine to be packaged in the next package (here, the fifth package) can be stored. Third right side shutter 313 is brought into a state in which the medicine to be packaged in the next package (here, the fourth package) can be stored. First right side shutter 311 is brought into a state in which the medicine to be packaged in the next package (here, the third package) can be stored.

At time T18, the controller starts outputting the driving signal to each driving portion provided in fourth left side discharging portion 243 and second left side discharging portion 223. Herewith, the medicine stored inside fourth left side tablet case 241 and second left side tablet case 221 is discharged toward fourth left side discharging portion 243 and second left side discharging portion 223, respectively. Here, the controller can drive each driving portion of fourth left side discharging portion 243 and second left side discharging portion 223 up to time T19 at most (see the diagram (7) of FIG. 6). At this time, the medicine discharged toward fourth left side discharging portion 243 is a medicine packaged in the fourth package in packaging unit 15. The medicine discharged toward second left side discharging portion 223 is a medicine to be packaged in the third package in packaging unit 15.

During time T18 to time T19, the controller maintains fourth left side shutter 304 and second left side shutter 302 in the closed state discharging path is closed (see the diagram (4) of FIG. 6). Herewith, the medicine discharged from fourth left side tablet case 241 is stored in the storage space formed by closing the discharging path by fourth left side shutter 304. The medicine discharged from second left side tablet case 221 is stored in a storage space formed by closing the discharging path second left side shutter 302.

At time T18, the controller shifts third storage 236 and first storage 216 from the closed state of closing path 26 to the opened state of opening path 26 (see the diagram (3) of FIG. 6). Herewith, the medicine stored in third storage 236 drops toward second storage 226. The medicine stored in first storage 216 drops toward hopper 13 together with the medicine discharged toward path 26 by opening the discharging portion by first right side shutter 311.

By the above operation, the medicines in the second package including the medicine stored in fifth right side tablet case 252, fourth left side tablet case 241, third right side tablet case 232, second left side tablet case 221, and first right side tablet case 212 are supplied toward packaging unit 15 of first floor 10

Thereafter, the controller shifts third storage 236 and first storage 216 from the opened state of opening path 26 to the closed state of closing path 26 (see the diagram (3) of FIG. 6). At time T19, third storage 236 and first storage 216 close path 26. Herewith, third storage 236 is brought into a state in which the medicine to be packaged in the next package (here, the fourth package) can be stored. First storage 216 is brought into a state in which the medicine to be packaged in the next package (here, the third package) can be stored.

At time T18 to time T19, the controller maintains fourth storage 246 and second storage 226 in the closed state of closing path 26 (see the diagram (2) of FIG. 6). Herewith, the medicine discharged toward path 26 by opening the discharging path by third right side shutter 313 and the medicine stored in third storage 236 are received by second storage 226 and stored in second storage 226. The medicine discharged toward path 26 by opening the discharging path by fifth right side shutter 315 is received by fourth storage 246 is stored in fourth storage 246.

Thereafter, by repeating the same operation by second floor 20, medicine packaging apparatus 1 can cause the medicine discharged from fifth right side tablet case 252, fourth left side tablet case 241, third right side tablet case 232, second left side tablet case 221, and first right side tablet case 212 to be included in each of a plurality of consecutive packages. Therefore, for example, in the case of dispensing according to a prescription instructing to take exactly the same medicine twice a day, in the morning and in the evening, the medicine can be efficiently packaged by performing the consecutive discharging operation.

[Every Other Time Discharging Operation]

Hereinafter, the every other time discharging operation will be described focusing on the difference from the consecutive discharging operation. Matters not specifically described in the following description are the same as those in the consecutive discharging operation.

At time T13, the controller starts outputting the driving signal to each driving portion provided in fifth right side discharging portion 254, third right side discharging portion 234, and first right side discharging portion 214. Here, the controller can drive each driving portion of, fifth right side discharging portion 254, third right side discharging portion 234, and first right side discharging portion 214 up to time T16 at most (see the diagram (8) of FIG. 6). That is, fifth right side discharging portion 254, third right side discharging portion 234, and first right side discharging portion 214 can spend a maximum time from time T13 to time T16, to discharge the medicine stored in fifth right side tablet case 252, third right side tablet case 232, and first right side tablet case 212, respectively. This maximum time is longer than the maximum time that can be secured for discharging the medicine inside fifth right side tablet case 252, third right side tablet case 232, and first right side tablet case 212 toward fifth right discharging portion 254, third right discharging portion 234, and first right discharging portion 214, respectively, when the continuous discharging operation is performed.

At this time, the medicine discharged toward fifth right side discharging portion 254 is a medicine packaged in the third package in packaging unit 15. The medicine discharged toward third right side discharging portion 234 is a medicine to be packaged in the second package in packaging unit 15. The medicine discharged toward first right side discharging portion 214 is a medicine to be packaged in the first package in packaging unit 15.

At time T14 to time T15, the controller maintains fifth right side shutter 315, third right side shutter 313, and first right side shutter 311 in the closed state (see the solid line in the diagram (5) of FIG. 6). That is, during time T14 to time T15, fifth right side shutter 315, third right side shutter 313, and first right side shutter 311 do not discharge the medicine from each storage space to path 26.

At time T14, the controller starts outputting the driving signal to each driving portion provided in fourth left side discharging portion 243 and second left side discharging portion 223. Here, the controller can drive the driving portion of fourth left side discharging portion 243 and second left side discharging portion 223 up to time T17, respectively (see the diagram (9) of FIG. 6). That is, fourth left side discharging portion 243 and second left side discharging portion 223 can spend a maximum time from the time T14 to time T17 to discharge the medicine stored in fourth left side tablet case 241 and second left side tablet case 221, respectively. This maximum time is also longer than the maximum time that can be secured for discharging the medicine inside fourth left side tablet case 241 and second left side tablet case 221 toward fourth left side discharging portion 243 and second left side discharging portion 223, respectively, when the consecutive discharging operation is performed.

At this time, the medicine discharged from fourth left side tablet case 241 is a medicine to be packaged in the third package in packaging unit 15 The medicine discharged from second left side tablet case 221 is a medicine to be packaged in the second package in packaging unit 15

At time T15 to time T16, the controller maintains fourth left side shutter 304 and second left side shutter 302 in the closed state (see the solid line in the diagram (4) of FIG. 6). That is, during time T15 to time T16, fourth left side shutter 304 and second left side shutter 302 do not discharge the medicine from each storage space to path 26.

By time T16, the medicine in fifth right side tablet case 252, third right side tablet case 232, and first right side tablet case 212 needs to be discharged toward fifth right side discharging portion 254, third right side discharging portion 234, and first right side discharging portion 214, respectively. Therefore, the controller drives the driving portion of fifth right side discharging portion 254 until the medicine is discharged toward fifth right side discharging portion 254. The controller stops the driving of the driving portion when the medicine detecting sensor of fifth right side discharging portion 254 detects that the specified number of medicines have passed through the discharging path. Similarly, the controller drives each driving portion of third right side discharging portion 234 and first right side discharging portion 214 and stops the driving of each driving portion. The diagram (8) of FIG. 6 illustrates a state in which the specified number of medicines have passed through the discharging path, the driving portion of fifth right side discharging portion 254, the driving portion of third right side discharging portion 234, and the driving portion of first right side discharging portion 214 have stopped, at time T16. The controller may stop the driving of the driving portion of fifth right side discharging portion 254, the driving of the driving portion of third right side discharging portion 234, and the driving of the driving portion of first right side discharging portion 214, at a predetermined timing at which the specified number of medicines can be expected to pass through the discharging path, for example, at time T16.

At time T16, the controller shifts fifth right side shutter 315, third right side shutter 313, and first right side shutter 311 from the closed state to the opened state, respectively (see the diagram (5) of FIG. 6). The medicine discharged by the driving of each driving portion of fifth right side discharging portion 254, third right side discharging portion 234, and first right side discharging portion 214, started from time T13, is discharged from each storage space to path 26, by opening fifth right side shutter 315, third right side shutter 313, and first right side shutter 311, at time T16 to time T17.

By time T17, the medicine in fourth left side tablet case 241 and second left side tablet case 221 needs to be discharged toward fourth left side discharging portion 243 and second left side discharging portion 223, respectively. Therefore, the controller drives the driving portion of fourth left side discharging portion 243 until the medicine is discharged toward fourth left side discharging portion 243. The controller stops the driving of the driving portion of fourth left side discharging portion 243 when the medicine detecting sensor of fourth left side discharging portion 243 detects that the specified number of medicines have passed through the discharging path. Similarly, the controller drives the driving portion of second left side discharging portion 223, and stops the driving of the driving portion. The diagram (9) of FIG. 6 illustrates a state in which the specified number of medicines have passed through the discharging path, and the driving of the driving portion of fourth left side discharging portion 243 and the driving portion of second left side discharging portion 223 have stopped, at time T17. The controller may stop the driving of the driving portion of second left side discharging portion 223 and the driving of the driving portion of fourth left side discharging portion 243, at a predetermined timing at which the specified number of medicines can be expected to pass through the discharging path, at time T17.

At time T17, the controller shifts fourth left side shutter 304 and second left side shutter 302 from the closed state to the opened state, respectively (see the diagram (4) of FIG. 6). The medicine discharged by the driving of each driving portion of fourth left side discharging portion 243 and second left side discharging portion 223, started from time T14, is discharged from each storage space to path 26, by opening fourth left side shutter 304 and second left side shutter 302, at time T17 to time T18.

At time T17, the controller drives each driving portion of fifth right side discharging portion 254, third right side discharging portion 234 and first right side discharging portion 214, similar to the driving operation performed during time T13 to time T16 (see the diagram (8) of FIG. 6).

At time T18 to time T19, the controller maintains fifth right side shutter 315, third right side shutter 313, and first right side shutter 311 in the closed state (see the solid line in the diagram (5) of FIG. 6).

Thereafter, by repeating the same operation by second floor 20, medicine packaging apparatus 1 can cause the medicine discharged from fifth right side tablet case 252, fourth left side tablet case 241, and first right side tablet case 212 to be included in each of the odd number packages. Medicine packaging apparatus 1 can cause the medicine discharged from third right side tablet case 232 and second left side tablet case 221 in each of the even number packages. Therefore, for example, in the case of dispensing according to a prescription instructing to take the different medicines twice a day, in the morning and evening, the medicine can be efficiently packaged by performing the every other time discharging operation.

Although not illustrated in FIG. 6, it is needless to say that the operation of each discharging portion, each shutter, and each storage may be controlled so that the odd number package includes the medicine discharged from the tablet case other than fifth right side tablet case 252, fourth left side tablet case 241, or first right side tablet case 212. Similarly, it is needless to say that the operation of each discharging portion, each shutter, and each storage may be controlled so that the even number package includes the medicine discharged from the tablet cases other than third right side tablet case 232 or second left side tablet case 221.

In the present embodiment, second floor 20 has the shutter corresponding to each tablet case. Herewith, second floor 20 can start the operation of discharging the medicine from the storage section of each tablet case toward the discharging portion, from the time before the time when the medicine is discharged toward path 26, and can store the medicine in the storage space formed by closing the path leading to path 26 by the shutter. The medicine stored in the storage space is easily discharged to path 26 only by opening the shutter. Herewith, the medicine can be more reliably discharged into path 26 at the timing to be discharged toward path 26. Therefore, it is possible to more reliably prevent the medicines that should belong to the specific group from being mixed into other groups.

In particular, in the case where the situation in which the medicine stored in a specific one of a plurality of tablet cases included in the same drawer is continuously discharged is not occurred, as the every other time discharging operation, it is possible to perform the operation of discharging the medicine from each tablet case, from a time earlier than the time at which the medicine is discharged toward path 26. That is, it is possible to secure a longer period of time for continuing the operation of discharging the medicine from the storage section of each tablet case to the discharging portion. The longer the operation of discharging the medicine from the storage section of the tablet case toward the discharge portion is possible, the less likely the malfunction that the medicine is not discharged from the tablet case is occurred. Therefore, according to the present embodiment, since it is possible to secure a long period of time for continuing the operation of discharging the medicine from the storage section of the tablet case toward the discharging portion, it is possible to discharge the medicine to path 26 more reliably at the timing at which the medicine is to be discharged, and it is possible to further reliably prevent the medicine to belong to the specific group from being mixed into the other group. This effect is particularly large when a plurality of medicines inside the same tablet case are included in the same package. When a plurality of medicines inside the same tablet case are included in the same package, the time spent for discharging the specified number of medicines toward the discharging portion is longer than when one medicine is discharged from the tablet case. For this reason, the timing at which the specified number of medicines stored in the storage space are discharged to path 26 by the opening of the discharging path by the shutter may be delayed, and the timing at which the medicines are stored in the storage which periodically closes and opens path 26 may be delayed. That is, there is a possibility that the medicine that should have already dropped to the lower side of a certain storage is stored in the storage. Therefore, when a plurality of medicines are included in the same package from the inside of the same tablet case, it is more likely that the medicines to belong to a specific group are mixed into other groups. However, in the case of performing the every other time discharging operation, a longer time for discharging the medicine from the tablet case toward the discharging portion can be ensured, and therefore, even in the case where a plurality of medicines is included in the same package from the inside of the same tablet case, it is possible to reliably prevent the medicine to belong to the specific group from being mixed into another group.

This application is entitled to the benefit of Japanese Patent Application No. 2018-117671, filed on Jun. 21, 2018, the disclosure of which including the specification, drawings and abstract is incorporated herein by reference in its entirety.

INDUSTRIAL APPLICABILITY

The present invention is widely available in a medicine supplying apparatus and a medicine packaging apparatus.

REFERENCE SIGNS LIST

1 Medicine packaging apparatus
10 First floor
11 Operating portion
12 Take-out portion
13 Hopper
14 Opening and closing member
15 Packaging unit
16 Transferring portion
17 Printer
18 Sealing device
20 second floor
21 First drawer
211 First left side tablet case
**211*a*** Storage section
212 First right side tablet case
213 First left discharging portion
**213*a*** Driving portion

213*b* Discharging path
213*c* Medicine Detecting sensor
214 First right side discharging portion
215 First path
216 First storage
22 Second drawer
221 Second left side tablet case
222 Second right side tablet case
223 Second left side discharging portion
224 Second right side discharging portion
225 Second path
226 Second storage
23 Third drawer
231 Third left side tablet case
232 Third right side tablet case
233 Third left side discharging portion
234 Third right side discharging portion
235 Third path
236 Third storage
24 Fourth drawer
241 Fourth left side tablet case
242 Fourth right side tablet case
243 Fourth left side discharging portion
244 Fourth right side discharging portion
245 Fourth path
246 Fourth storage
25 Fifth drawer
251 Fifth left side tablet case
252 Fifth right side tablet case
253 Fifth left side discharging portion
254 Fifth right side discharging portion
255 Fifth path
26 Path
301 First left side shutter
301*a* Shaft
302 Second left side shutter
303 Third left side shutter
304 Fourth left side shutter
305 Fifth left side shutter
311 First right side shutter
312 Second right side shutter
313 Third right side shutter
314 Fourth right side shutter
315 Fifth right side shutter
500 Medicine
401 First left side shutter portion
S Storage space

The invention claimed is:

1. A medicine packaging apparatus comprising:

a packaging unit; and a medicine supplying apparatus for supplying medicine to the packaging unit, wherein:

the medicine supplying apparatus is disposed over the packaging unit so that the medicine drops from the medicine supplying apparatus to the packaging unit, the medicine supplying apparatus comprises:

a first drawer including a first medicine discharging portion configured to discharge a first medicine from a first tablet case storing the first medicine, and a first temporary storage disposed on a downstream side of the first medicine discharging portion in a path through which the first medicine drops, and configured to temporarily store the first medicine;

a second drawer including a second medicine discharging portion disposed on the downstream side of the first temporary storage in the path, and configured to discharge a second medicine from a second tablet case storing the second medicine, and a second temporary storage disposed on a downstream side of the second medicine discharging portion in the path and configured to temporarily store the first medicine and the second medicine; and a third drawer including a third medicine discharging portion disposed on the downstream side of the second temporary storage in the path, and configured to discharge a third medicine from a third tablet case storing the third medicine, the third drawer is a closest drawer to the packaging unit, and the third drawer is configured such that the third medicine is directly dropped from the third medicine discharging portion to the packaging unit.

2. The medicine packaging apparatus according to claim 1, wherein the third drawer has no temporary storage for temporarily storing the third medicine.

3. The medicine packaging apparatus according to claim 1, wherein the first medicine discharging portion is configured to discharge the first medicine when the first temporary storage is in a state of being capable of temporarily storing the first medicine or is shifting to the state of being capable of temporarily storing the first medicine, the second medicine discharging portion is configured to discharge the second medicine when the first temporary storage is in a state of being not capable of temporarily storing the first medicine or is shifting to the state of being not capable of temporarily storing the first medicine while the second temporary storage is in a state of being capable of temporarily storing the first medicine and the second medicine or is shifting to the state of being capable of temporarily storing the first medicine and the second medicine, and the third medicine discharging portion is configured to discharge the third medicine when the second temporary storage is in a state of being not capable of temporarily storing the first medicine and the second medicine or is shifting to the state of being not capable of temporarily storing the first medicine.

4. The medicine packaging apparatus according to claim 1, wherein the first temporary storage is disposed at a position closer to the first medicine discharging portion between the first medicine discharging portion and the second medicine discharging portion, and the second temporary storage is disposed at a position closer to the second medicine discharging portion between the second medicine discharging portion and the third medicine discharging portion.

5. The medicine packaging apparatus according to claim 1, wherein the first temporary storage and the second temporary storage have a mechanism configured to open and close the path.

* * * * *